US010515516B1

(12) United States Patent
Eckman et al.

(10) Patent No.: US 10,515,516 B1
(45) Date of Patent: Dec. 24, 2019

(54) PEER-TO-PEER COMPETITION WAGERING EXCHANGE NETWORK

(71) Applicants: Andrew Eckman, Dallas, TX (US); Charles Reinert, Weatherford, TX (US)

(72) Inventors: Andrew Eckman, Dallas, TX (US); Charles Reinert, Weatherford, TX (US)

(73) Assignee: POSTITPLAYIT, INC., Addison, TX (US)

( * ) Notice: Subject to any disclaimer, the term of this patent is extended or adjusted under 35 U.S.C. 154(b) by 0 days.

(21) Appl. No.: 16/186,570

(22) Filed: Nov. 11, 2018

Related U.S. Application Data

(60) Provisional application No. 62/722,301, filed on Aug. 24, 2018.

(51) Int. Cl.
*G07F 17/32* (2006.01)

(52) U.S. Cl.
CPC ..... *G07F 17/3288* (2013.01); *G07F 17/3225* (2013.01); *G07F 17/3244* (2013.01); *G07F 17/3276* (2013.01)

(58) Field of Classification Search
CPC .. G07F 17/32; G07F 17/3276; G07F 17/3225; G07F 17/3244; G07F 17/3288
See application file for complete search history.

(56) References Cited

U.S. PATENT DOCUMENTS

| | | | |
|---|---|---|---|
| 6,527,270 | B2 | 3/2003 | Maksymec et al. |
| 7,364,509 | B2 | 4/2008 | Slade |
| 7,699,701 | B2 | 4/2010 | Corbo |
| 8,538,563 | B1 | 9/2013 | Barber |

(Continued)

FOREIGN PATENT DOCUMENTS

| | | | |
|---|---|---|---|
| WO | WO0155941 | A2 | 8/2001 |
| WO | WO16100941 | A2 | 6/2016 |

(Continued)

OTHER PUBLICATIONS

Dalke, Jim, "The Bait App Wants to Let You and Your Friends Bet on Sports . . . Legally", Jul. 18, 2018, 2 pp., retrieved on Feb. 9, 2018 from: <https://www.americaninno.corn/chicago/2016/07/18/sports-betting-app-bait-is-legal-gambling-with-venmo-payment/>.

(Continued)

*Primary Examiner* — Jasson H Yoo
(74) *Attorney, Agent, or Firm* — Law Office of Sam Sokhansanj PLLC

(57) ABSTRACT

A peer-to-peer competition wagering exchange network method and system is disclosed which in one exemplary embodiment can include receiving schedule data associated with a competition or game-based event, receiving a selection from a first user to participate in the competition or event, receiving a selection from the first user for a competitor associated with the competition, and receiving a wagered, placed, or contributed monetary amount or token of value with respect to the selected competitor from the first user. The method can further include receiving a point spread or line with respect to the competition from the first user, and generating a challenge, contest, or campaign based on the received selected competitor, received wagered amount, and received point or spread by the first user.

16 Claims, 25 Drawing Sheets

(56) References Cited

U.S. PATENT DOCUMENTS

| | | | | |
|---|---|---|---|---|
| 8,585,496 | B2 | 11/2013 | Demino et al. | |
| 8,651,957 | B2 | 2/2014 | Goldman et al. | |
| RE45,040 | E | 7/2014 | Fish et al. | |
| 8,814,660 | B2 | 8/2014 | Thompson | |
| 9,257,015 | B2 | 2/2016 | Cornett | |
| 9,443,392 | B2 | 9/2016 | Keech | |
| 9,773,382 | B1 | 9/2017 | Korner | |
| 9,868,056 | B2 | 1/2018 | Kehoe et al. | |
| 2002/0155885 | A1 | 10/2002 | Shvili | |
| 2010/0058249 | A1* | 3/2010 | Sarkar | G06Q 30/02 715/856 |
| 2010/0144426 | A1* | 6/2010 | Winner | G07F 17/32 463/25 |
| 2011/0053681 | A1 | 3/2011 | Goldman et al. | |
| 2012/0289323 | A1 | 11/2012 | Whitmire | |
| 2013/0225271 | A1 | 8/2013 | Amaitis | |
| 2014/0024435 | A1 | 1/2014 | Scott | |
| 2014/0256445 | A1 | 9/2014 | Amaitis et al. | |
| 2014/0274311 | A1 | 9/2014 | Aronowitz | |
| 2014/0329584 | A1 | 11/2014 | Thompson | |
| 2015/0254937 | A1 | 9/2015 | Sanchez | |
| 2016/0016073 | A1 | 1/2016 | Elias et al. | |
| 2016/0045825 | A1 | 2/2016 | Kehoe et al. | |
| 2016/0086440 | A1 | 3/2016 | Kehoe et al. | |
| 2016/0101353 | A1 | 4/2016 | Kehoe | |
| 2016/0104352 | A1 | 4/2016 | Kehoe | |
| 2016/0140804 | A1* | 5/2016 | Morgan | G07F 17/3244 463/42 |
| 2017/0140605 | A1 | 5/2017 | Lewski | |
| 2017/0232351 | A1 | 8/2017 | Thompson | |
| 2017/0358173 | A1 | 12/2017 | McCafferty | |
| 2018/0015374 | A1 | 1/2018 | Kehoe | |
| 2018/0211353 | A1* | 7/2018 | Mahasuverachai | G06Q 50/34 |

FOREIGN PATENT DOCUMENTS

| | | | | |
|---|---|---|---|---|
| WO | WO16100942 | A1 | 6/2016 | |
| WO | WO2016110797 | A1 | 7/2016 | |
| WO | WO17011262 | A1 | 1/2017 | |
| WO | WO17161015 | A1 | 9/2017 | |
| WO | WO-2017161015 | A1 * | 9/2017 | G07F 17/32 |

OTHER PUBLICATIONS

Heitner, Darren, "New Peer-To-Peer Sports Betting App Says 'Screw the Bookie, Bet Your Friends'", Oct. 8, 2012, 4 pp., retrieved on Feb. 9, 2018 from: <https://www.forbes.corn/sites/darrenheitner/2012/10/08/new-peer-to-peer-sports-betting-app-says-screw-the-bookie-bet-your-friends/#5bb75cac41c5>.

"Top 5 Peer-To-Peer Social Sports Betting Apps", Aug. 18, 2014, 5 pp., retrieved on Feb. 9, 2018 from: <http://www.sportsbettingapps.net/blog/top-5-peer-to-peer-social-sports-betting-apps>.

* cited by examiner

PEER-TO-PEER COMPETITION WAGERING EXCHANGE NETWORK

CROSS-REFERENCE TO RELATED APPLICATION

This application claims the benefit of U.S. Provisional Application Ser. No. 62/722,301 filed on Aug. 24, 2018, which is incorporated herein by reference in its entirety.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Betting on sporting events, challenge type games, contests, or various competitions is thought to be an activity that enhances the fun for sports fans during the actual games, challenges, or competitions because the bet represents an interest for the individual in the outcome of the game or contest. However, many individuals do not participate in this activity due to the strict restrictions placed on such betting and/or fear of not being able to recover any winnings from losing individual(s) of the bet.

In traditional betting or wagering games, the game operator generally acts as a market maker. The game operator could balance the amounts of bets and expected payout by setting and adjusting the odds that determine the payout of a bet or wager on a particular betting proposition or by adjusting the spread between the two sides of a comparative bet. For example, a game operator could increase the odds to yield a higher payout in order to attract more bets on an undersubscribed event in the betting pool. A game operator could also add or adjust a point spread to a comparative bet, i.e., adding a required performance condition to raise the winning threshold for one side in order to attract more bets to the other side. Current gaming and/or betting methods typically involve a user placing bets with the game operator or an entity that acts as the gaming house. This is true whether or not the user is betting against other users, and regardless of what the subject of the bet is. This gaming house performs various functions including the aforementioned setting odds, arbitrating, declaring winners, collecting funds, and providing payouts.

Generally, in most types of betting situations, odds are used in order to balance the amount of money bet on each team or side, so as to protect the individual or establishment taking the bet from losing money. For example, games where there is a powerful team/side taking on a weaker team/side would obviously generate more bets for the more powerful team/side. Odds are introduced to deter some of those who would place bets on the powerful team/side. These odds can be in the form of a point spread (or line), which can force the favored team/side to win by a certain amount of points or the underdog team/side to lose by less than those points, in order for someone betting on them to collect. These odds fluctuate as bets are taken, so the total amount of money bet on one team/side is the same or very close to the same as on the other team/side. Each game provider, market maker, gaming house, or sports book, which takes bets can set different odds, depending on what bets they have already taken. For a prospective bettor, the current odds for each gaming house or sports book are important because they may want to bet on a game at certain odds. Typically, in order to become aware of the lines/odds of a sports book, one must contact each game provider, gaming house, or sports book and inquire as to the current odds. By the time the individual has contacted all of the sports books and decided on one to place a bet with, the line/odds may have changed. Such a system is inefficient, ineffective, and highly cumbersome to a potential better, which can further result in potential lost winnings or prevent a potential better from even entering into a bet.

Hence, what is needed is a reliable, effective, and efficient method and system for allowing various users or potential betters to join a network exchange, wherein each user can post and set his or her odds for a given competition, contest, or game and invite other users to that competition. Moreover, what is needed is a method and system that can reliably and automatically distribute payouts on the bet winnings to a winning better without the winning better requesting payment, among others.

BRIEF SUMMARY

In one aspect of the disclosure described herein, a peer-to-peer competition wagering exchange (CWE) network method is disclosed. Here, the CWE method can include receiving schedule data associated with a competition or event, receiving a selection from a first user to participate in the competition or event, receiving a selection from the first user for a competitor associated with the competition or event, receiving a wagered, placed, or contributed monetary amount or token of value with respect to the selected competitor from the first user, receiving a point spread or line with respect to the competition or event from the first user, and generating a challenge, contest, or campaign based on the received selected competitor, received wagered amount, and received point or spread by the first user. The method can further include publishing the challenge within a peer-to-peer network forum, and further including receiving a request from a second user to participate in the challenge. The method can also include receiving a selection from the second user for a competitor associated with the competition or event, receiving a wagered, placed, or contributed monetary amount or token of value with respect to the selected competitor by the second user and the point or spread received from the first user. In addition, the method can include receiving outcome or score data with respect to the competition or event. In addition, the method can further include determining a winner, loser, or draw between the first user and second user in the challenge based on the received outcome or score data with respect to the competition or event. Further, on the condition that a winner is determined, calculating a monetary amount or token of value to be awarded to the winner. Here, the point spread or line can be defined via an interactive visual slider. In addition, a minimum and maximum value for the point spread or line can be pre-defined. The method can also include creating an account for the first user for receiving monetary funds or token of value from the first user.

In another aspect of the disclosure described herein, a peer-to-peer competition wagering system is disclosed. Here, the system can include a first module for receiving scheduling data associated with a competition, a second module for receiving a selection from a first user to participate in the competition, a third module for receiving a selection from the first user for a competitor associated with upcoming competition, a fourth module for receiving a wagered, placed, or contributed monetary amount or token of value with respect to the selected competitor from the first user, a fifth module for receiving a point spread or line with respect to the competition from the first user, and a sixth module for generating a challenge, contest, or campaign based on the received selected competitor, received wagered amount, and received point or spread by the first user.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

Figure 1:
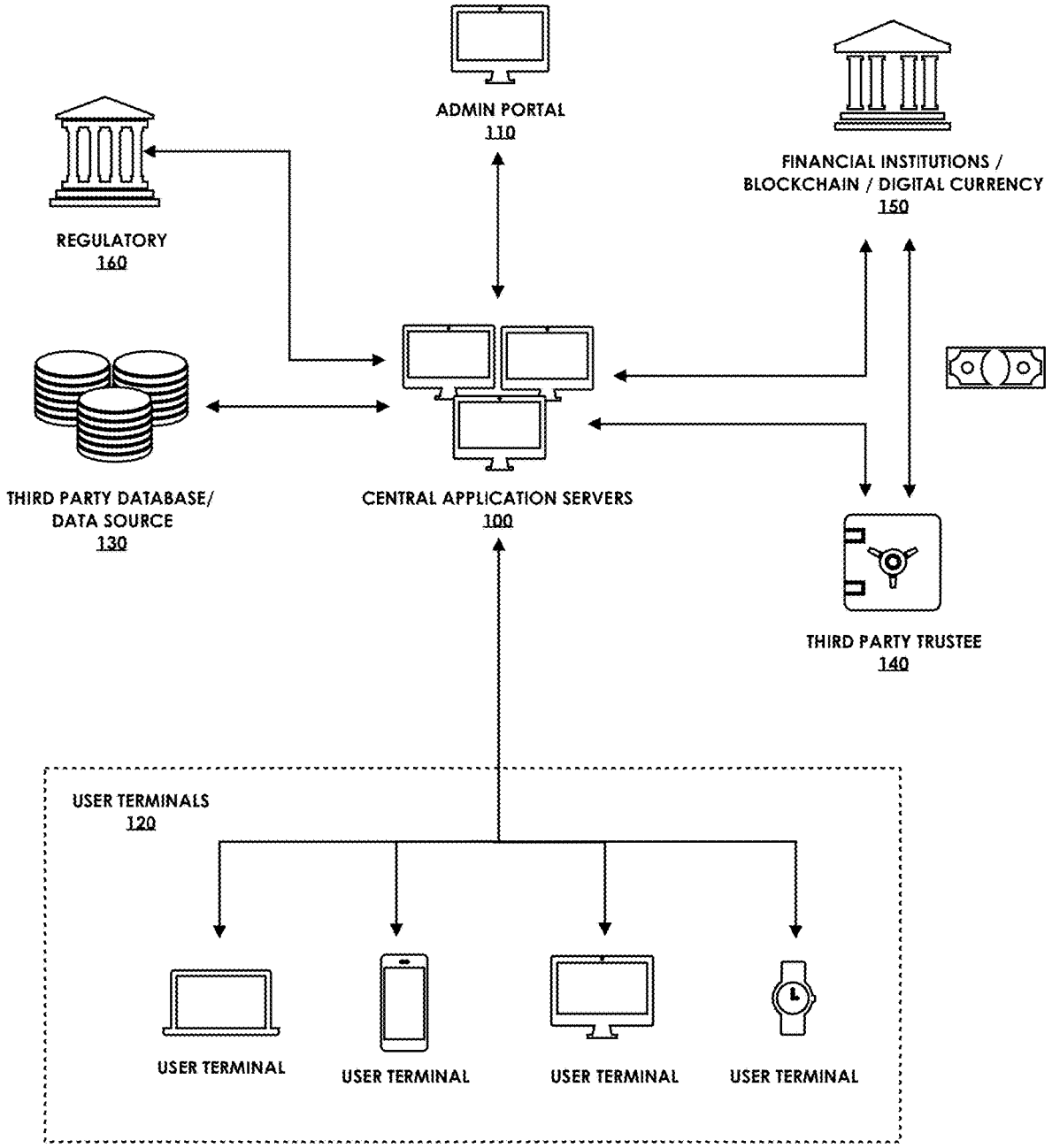
FIG. 1 illustrates an overview network diagram of a network architecture for the Peer-to-Peer Competition Wagering Exchange Network method, application, and system (hereinafter "CWE") according to one non-limiting exemplary embodiment of the disclosure described herein.

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

In one implementation of the disclosure described herein, a display page may include information residing in the computing device's memory, which may be transmitted from the computing device over a network to a central database center and vice versa. The information may be stored in memory at each of the computing device, a data storage resided at the edge of the network, or on the servers at the central database centers. A computing device or mobile device may receive non-transitory computer readable media, which may contain instructions, logic, data, or code that may be stored in persistent or temporary memory of the mobile device, or may somehow affect or initiate action by a mobile device. Similarly, one or more servers may communicate with one or more mobile devices across a network, and may transmit computer files residing in memory. The network, for example, can include the Internet, wireless communication network, or any other network for connecting one or more mobile devices to one or more servers.

Any discussion of a computing or mobile device may also apply to any type of networked device, including but not limited to mobile devices and phones such as cellular phones (e.g., an iPhone®, Android®, Blackberry®, or any "smart phone"), a personal computer, iPad®, server computer, or laptop computer; personal digital assistants (PDAs) such as a Palm-based device or Windows® CE device; a roaming device, such as a network-connected roaming device; a wireless device such as a wireless email device or other device capable of communicating wireless with a computer network; or any other type of network device that may communicate over a network and handle electronic transactions. Any discussion of any mobile device mentioned may also apply to other devices, such as devices including Bluetooth®, near-field communication (NFC), infrared (IR), and Wi-Fi functionality, among others.

Phrases and terms similar to "software", "application", "app", and "firmware" may include any non-transitory computer readable medium storing thereon a program, which when executed by a computer, causes the computer to perform a method, function, or control operation.

Phrases and terms similar to "credit" may include one or more coupons, rewards, discounts, cash, credit, monetary amount, goods, gifts, prices, services, experiences, offers, token of value, or the like.

Phrases and terms similar "network" may include one or more data links that enable the transport of electronic data between computer systems and/or modules. When information is transferred or provided over a network or another communications connection (either hardwired, wireless, or a combination of hardwired or wireless) to a computer, the computer uses that connection as a computer-readable medium. Thus, by way of example, and not limitation, computer-readable media can also comprise a network or data links which can be used to carry or store desired program code means in the form of computer-executable instructions or data structures and which can be accessed by a general purpose or special purpose computer.

Phrases and terms similar to "portal" or "terminal" may include an intranet page, internet page, locally residing software or application, mobile device graphical user interface, or digital presentation for a user. The portal may also be any graphical user interface for accessing various modules, features, options, and/or attributes of the disclosure described herein. For example, the portal can be a web page accessed with a web browser, mobile device application, or any application or software residing on a computing device.

FIG. 1 illustrates one non-limiting exemplary embodiment for a network architecture of the Peer-to-Peer Competition Wagering Exchange Network application, method, and system (hereinafter "CWE") of the disclosure described herein. Here, the CWE can include one or more central servers, databases, or application servers 100 which can communicate bi-directionally with one or more of an administrator or admin portal 110, one or more users or user terminals 120, one or more third party database or data source 130, one or more third party trustee users, entities, or systems 140, one or more financial institutions/block chain/digital currency exchange or settlement entities or systems 150, and one or more regulatory or oversight entities or systems 160. Here, the CWE is, among others, a peer-to-peer network wherein one or more users, via the user terminals, can communicate with each other via the main servers 100 of the disclosure described herein. Generally, in a peer-to-peer network, each node is connected to other nodes over a communication medium, such as the internet, either directly or through some type of proxy. For example, users may compete with each other by setting odds/prediction via a spread or line for a particular sports game, competition, challenge, or contest and committing funds towards that spread or line.

Still referring to FIG. 1, users may also invite other users for that particular competition and further communicate with other users via social network, chatting, groups, and the like. In addition, third party data sources 130 can include providers of real-time sports or competition data, including but not limited to SPORTRADAR®. In addition, third party trustees 140 may be one or more banks or institutions that can hold one or more funds in a trust or trust account for distribution. Financial institutions 150 may be any type of banking or financial institution, blockchain network, distributed electronic ledger, or any currency exchange or funds settlement system. Regulatory or oversight system 160 may be any type of portal, system, or servers that may automatically or manually provide legal, education, protocol, or administrative guidance or oversight for any type of transaction, user, or competition of the CWE.

Figure 2:
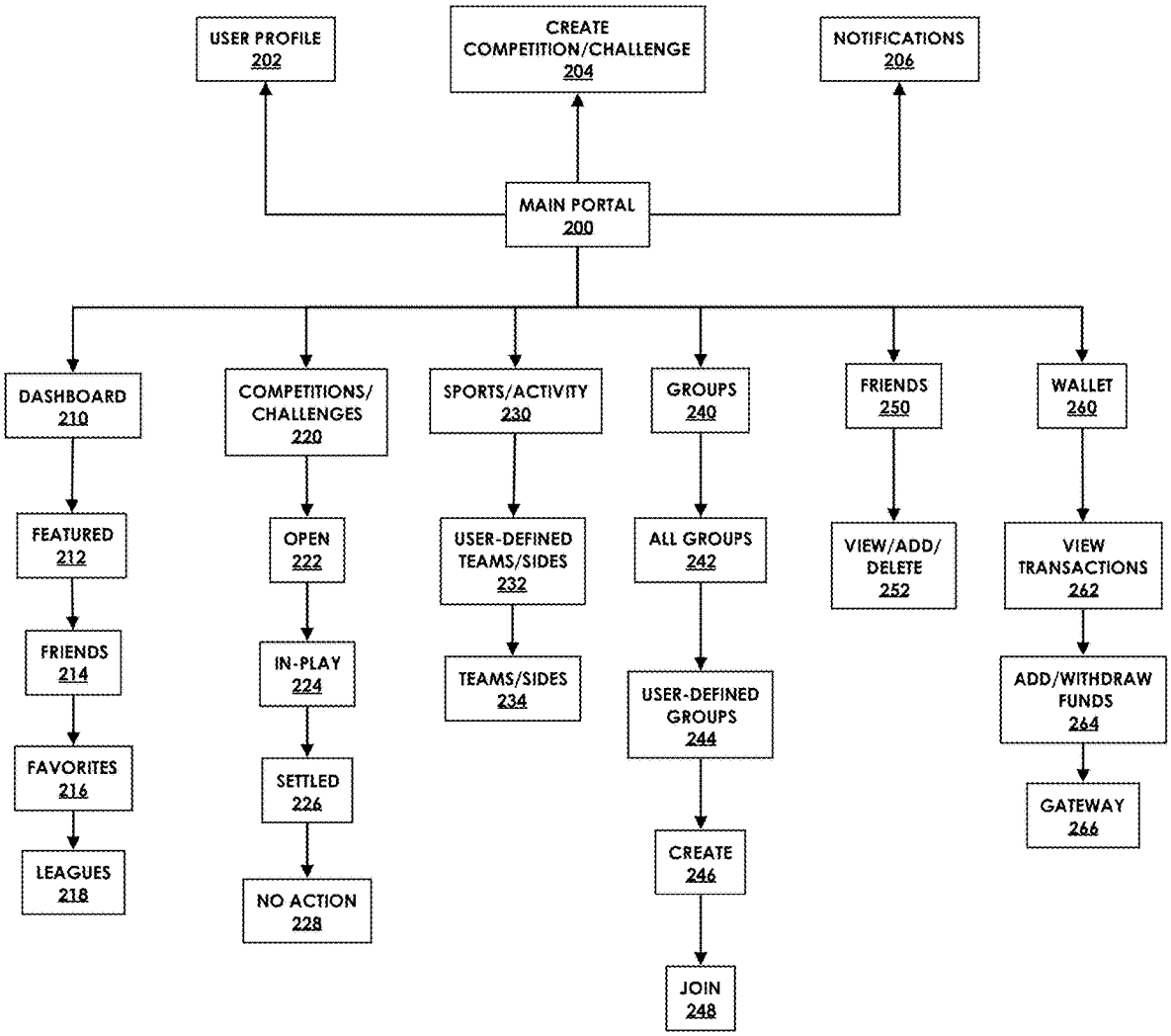
FIG. 2 illustrate an overview block diagram of various modules within one or more portals for the CWE according to one non-limiting exemplary embodiment of the disclosure described herein.

FIG. 2 illustrates one non-limiting exemplary embodiment for various modules, structures, portals, or functional/executable applications of the CWE. In particular, the CWE may include a main portal 200 which can allow one or more users to access their user profile 202 module, which may include any information about the user, such as name, place, date of birth, preferences, and the like. In addition, users of the CWE may be provided with the option to publish one or more types of user data to other users of the CWE. Further, users may also be provided with a global option to create a competition, contest, challenge, or campaign 204 at any time. The CWE may also include a global notifications 206 module which can provide the user with any real-time, past, or future notification with respect to any aspect of the CWE, including but not limited to, news, messages, prior/current game scores, prior/current competition outcomes, prior/current/upcoming competitions, friends updates, group updates, or real-time data, among others. In addition, the global notifications can further include information with respect to how much available funds a user has in his or her account or wallet in connection with the CWE for game play, creating, or participating in a competition. Here, any of modules 202-206 may be user selectable icons or indicia within one or more portals, such as via the main portal 200.

Still referring to FIG. 2, the main portal 200 can further include a dashboard module/portal 210, competition module/portal 220, sports/game/activity module/portal 230, group module/portal 240, friends module/portal 250, and a wallet/funds account module/portal 260. Specifically, dashboard 210 can include a featured 212 sub-module or sub-portal for displaying a one or more featured/selected/preferred games, competitions, or activities. For example, such featured competitions can include real-time, past, or upcoming competitions. In addition, the user may enter such competitions from the featured 212 portal. In addition, friends 214 sub-module or sub-portal can display the user's associated friends and provide the user the ability to add additional friends or send invitations to potential friends. Here, it is contemplated within the scope of the disclosure that the CWE can include accounts of users (friends of users) created within the CWE network application itself (such as members of the CWE), or in the alternative, integrate with existing third-party social media networks and a user's friends (or follower's) on those social media networks or online forums, including but not limited to Facebook®, Instagram®, Twitter®, among others. The dashboard 210 can further include a favorites 216 sub-module or sub-portal. Here, the favorites 216 sub-module or sub-portal can include but is not limited to favorite or preferred teams, sports, competitions, or friends, among others. The leagues 218 sub-module or sub-portal can further include past, current, or upcoming games for each league for a given sport, including but not limited to, the MLB®, NBA®, NHL®, NFL®, NCAA®, among others.

Still referring to FIG. 2, main portal 200 can further include a competitions or events module or portal 220. Here, the competitions 220 module or portal can include open competitions 222 sub-module or sub-portal, in-play competitions 224 sub-module or sub-portal, settled competitions 226 sub-module or sub-portal, and a no competition action 228 sub-module or sub-portal. In particular, the open 222 sub-portal can include competitions that which the user is currently participating in or has placed his/her predictions, odds, and wagered monetary amount or token of value. The in-play 224 sub-portal can display current, live, or real-time competitions that are in-play or on-going in which the user is currently participating in or has placed his/her prediction, odds, and wagered monetary amount or token of value. The settled 226 sub-portal can display past and settled competitions for which the user has previously participated in or placed his/her prediction, odds, and wagered monetary amount or token of value. In addition, the no competition action 228 sub-portal can display competitions for which no action had been taken by the CWE, such as a cancelled competition or game.

Still referring to FIG. 2, main portal 200 may also include a sports or activity 230 sub-module or sub-portal. Here, the activity 230 sub-portal may include a user-defined teams/sides 232 sub-module or sub-portal, and a teams/sides 234 sub-module or sub-portal. Specifically, the user defined-teams/sides 232 can include the teams, leagues, sides, player(s), or individual(s) that the user prefers or has selected for one or more competitions. In addition, the teams/sides 234 can further display the user's various preferred or selected teams, leagues, sides, player(s), or individual(s) for the CWE.

Still referring to FIG. 2, the main portal 200 may further include a groups 240 sub-module or sub-portal. Here, the groups 240 may include an all groups 242 sub-module or sub-portal, user defined groups 244 sub-module or sub-portal, a create groups 246 sub-module or sub-portal, and a join groups 248 sub-module or sub-portal. In particular, all groups 242 may display all public or private groups of the CWE. For example, public groups may be groups having users or members that allow any user from the public or member of the CWE to join, whereas private groups may be groups that are closed off to the public and can only be joined by certain user defined friends or via invitation to other users of the CWE. Here, groups may pertain to any subject matter, such as groups for family members, groups for college alumni, groups for specific sport teams or leagues, groups for certain hobbies or professions, and the like. The user-defined groups 244 or create groups 246 can be certain groups that are created by users of the CWE, that can be designated as private or public. The join groups 244 can provide the ability for the user to join a specific selected group or request an invitation to be invited to join the group by its members or admin.

Still referring to FIG. 2, a friends 250 sub-module or sub-portal can allow the user to view his or her friends that may be part of the CWE or associated with the user via one or more social networking websites or online forums. In particular, the view/add/delete 252 sub-module can allow the user to view, add, modify, or remove any one or more of his or her friends within or associated with the CWE. In addition, the user may also be able to view any pending requests from other users desiring to be connected with the user as friends within the CWE. Here, the CWE may also include a unique weblink or user identifier code that can be shared or sent to individuals via email, text, or messaging that would allow an individual who is not a member of the CWE to become a member or become connected or friends with a particular user.

Still referring to FIG. 2, a wallet 250 sub-module or sub-portal can allow the user to view current or prior transactions 262, add funds 264, and provide a payment gateway 266. Here, the wallet 250 sub-module allows the CWE to automatically credit the user's account upon a successful win from a competition for which the user participated in, among other functions. Here, the view transactions 262 sub-module or sub-portal can allow the user to see prior or current transactions pertinent to the user. For example, such transactions can include total monetary funds or tokens of value in the user's account or wallet, which can include prior winnings or losses. In addition, such transactions can further include dates/times for which the monetary funds or tokens of value were transferred to/from the user's financial institution. The add funds 264 sub-module or sub-portal can allow the user to submit, transfer, or add funds to his or her account or wallet 260 within the CWE. Here, the user can add funds in various modalities, such as via credit card, ACH transfer, PayPal®, Bitcoin, or any other type of currency or token of value. In addition, the user may withdraw or transfer any amount of funds or tokens of value from his or her account to any desired individual, user, friend, entity, system, or financial institution. In addition, the gateway 266 sub-module or sub-portal can provide a payment gateway that allows the user to further fund his or her account or wallet 260.

Figure 3:
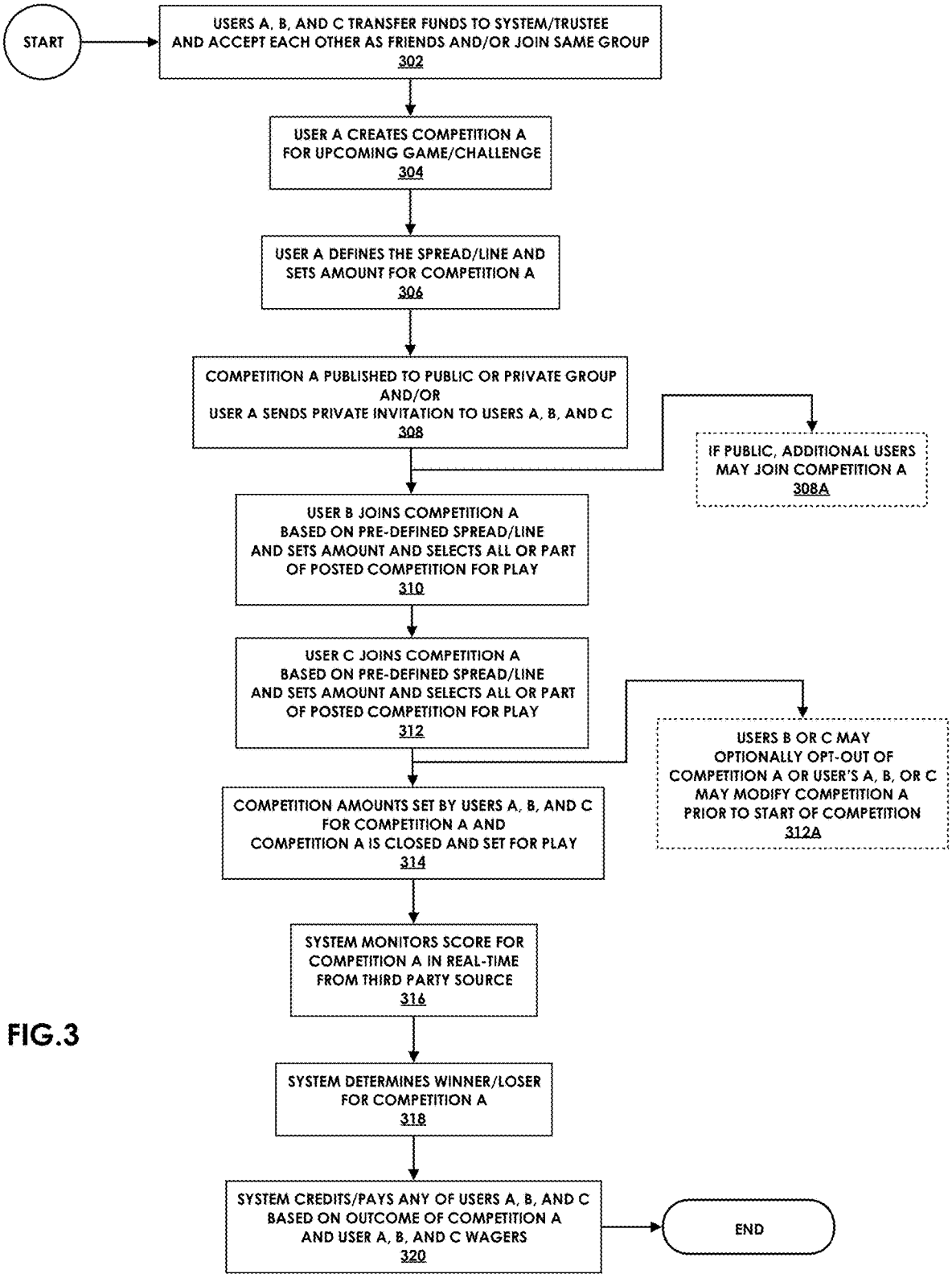
FIG. 3 illustrates a block diagram process flow chart for one method of operation of the CWE according to one non-limiting exemplary embodiment of the disclosure described herein.

FIG. 3 illustrates one non-limiting exemplary embodiment of a method of operation for the CWE of the disclosure described herein. Here, the user can first register or become a member with the CWE. Upon becoming a member of the CWE, the user may then be able to participate in any type of competition within the CWE. At step 302, users A, B, and C who are registered members or users of the CWE, may transfer monetary funds or tokens of value via the wallet module of the disclosure described herein into their own respective accounts or wallet. In one embodiment, the CWE can place the received funds within a third-party trust account or one or more trust accounts associated with the user's funds/account and/or the CWE. Here, the CWE may charge each user a service charge, such as a percentage of the total funds transferred into an account. For example, the CWE may place a certain amount of funds into a first trust, and a certain amount of funds into a second trust once a threshold amount or deposits for that first trust have been met, wherein such process may be automated. Specifically, the CWE may automatically direct funds into various trust accounts associated with one or more entities, and further direct those trust accounts or entities to transfer funds into a user's financial institution, bank account, credit account, digital currency settlement account, currency exchange account, digital currency ledger, among others, or alternatively issue cash, check, tokens, coupons, promotions, credits, and incentives, among others.

Still referring to FIG. 3, at step 302, each user A, B, and C can further be connected "friends" or connected with each other via the CWE or other third-party social media network, or be part of the same group within the CWE. Alternatively, each user A, B, and C may not necessarily need to be connected with each other as "friends" in order to participate in a competition. At step 304, user A may create a competition A via the competition module of the disclosure described herein. Specifically, user A may select amongst a variety of current or upcoming competitions, games, contests, and the like. Here, the CWE can display the current or upcoming competition, including data such as the teams or competitors competing with each other, date, time, or countdown timer to the start of the real-time competition. From here, the CWE can receive user A's selected desired competition, which will then navigate the user to an option for setting his/her prediction, point spread or line, and/or odds with respect to the selected competition.

Still referring to FIG. 3, at step 306, the CWE will allow the user the ability to set his/her prediction, point spread or line, and/or odds with respect to the selected competition. In particular, the CWE can provide user A with the option to set and define his/her own customized point spread or line with respect to the selected competition. Here, the CWE can first receive a selection from user A as to the team, side, or competitor which the user A desires or prefers with respect to the selected competition. Once the team, side, or competitor is selected, the user may enter the monetary amount or token of value he or she wishes to wager, contribute, place, or submit towards the prediction, or odds with respect to a winner, loser, or draw for the competition. Once the monetary amount or token is set, defined, and wagered, the user may then set or define the custom spread or line for the selected team, side, or competitor. Here, the spread or line can be set via a visual slider or sliding member dynamic graphical user interface icon or entered manually, such as negative (−) point spread for the favorite and a positive (+) point spread for the underdog in the competition for user A's selected team, side, or competitor. Here, the number after or associated with the negative (−) or the positive (+) is the amount a selected team has to win or lose by in order for the competition wager to pay off. In an embodiment, based on prior or current analyzed data, the CWE may also provide a suggestion as to whether other users of the CWE are more likely or less likely to participate in the competition based on the user's spread or line, or wagered amount. For example, such more likely or less likely suggestion may in the form of a chart, heat map, numerical scale, or any type of visual graphic.

Still referring to FIG. 3, at step 306, with respect to the sliding member, the CWE can automatically set pre-defined limits on minimums (negative point spread or line) and maximums (maximum point spread or line) for a particular type of competition. For example, with respect to a baseball competition, the sliding member can have a spread with minimum point of −5 and a maximum point of +5, or for football or basketball can have spread with a minimum point or −20 and a maximum point of +20. Alternatively, the CWE can further provide the option to a user to customer the minimum or maximum spread or lines for the types of competitions, featured competitions, sports, or leagues that he/she prefers, such as in a preference setting within the CWE.

Still referring to FIG. 3, at step 306, the CWE may further provide the functionality for the user or user A to set a moneyline with the aforementioned sliding member. Here, a moneyline generally concerns which team, side, or competitor wins for the selected competition. In particular, user A may define a value, parameter, or token of value with respect to a negative (−) value for the favorite or a positive (+) value with respect to the underdog. In a monelyline scenario, user A may set the slider or manually enter and define various minimums or maximum values or tokens of value, such as from −200 to +200, and wherein user A selects or sets a value via the sliding member (or manually enters the value) between the minimum and maximum values for the moneyline. For example, if the user wagers, contributes or places an amount for $150 and sets a moneyline of −150 for a selected team (i.e. predicting the team favorite will win) within the CWE, then if the team wins, the user can be credited with $250 in his or her wallet or account within the CWE. Alternatively, for example, if the user A wagers, places or contributes an amount of $150 and sets a moneyline of +$150, then if the team wins, the user can be credited with $300 in his or her wallet or account within the CWE.

Still referring to FIG. 3, at step 306, the CWE may also provide the user or user A with the functionality to set or wager total competition predictions or over/under predictions in lieu of or in addition to the aforementioned spread or lines. In particular, this type of competition prediction is based on whether or not the total amount points for a particular competition scored by both teams/sides of the competition will be over or under the set prediction by the user or user A of the CWE.

Still referring to FIG. 3, at step 308, the CWE can receive instruction or a selection from user A to post or publish competition A to the public, friends connected to the user, or within a private group, among others. Alternatively, user A may also send or transmit an invitation to users A, B, and C to join and participate in competition A. At step 310, user B can join or participate in competition A by wagering, placing or contributing a monetary amount or token of value for the prediction based on the spread or line previously defined by user A. Similarly, at step 312, user C can join or participate in competition A by placing, wagering, or contributing a monetary amount or token of value for the prediction based on the spread or line previously defined by user A. Here, once either of users B or C place, contribute, wager, or submit their monetary amount or token of value, then that monetary amount or token of value is then automatically withdrawn from user A's and user B's or C's total monetary amount funds or tokens of value within that user's account or wallet within the CWE. For example, once either user B accepts and joins user A's posted competition A and wagers funds, then neither user A nor B may be able to withdraw (or back out) of the competition, and funds from each user's account or wallet are locked and withdrawn to be contributed and wagered towards the competition. Alternatively, at step 312A, the CWE can allow user B or C the ability to opt-out of competition A prior to start of the competition, and in such a scenario, any monetary fund or token of value wagered, submitted, placed, or contributed towards the competition can be credited or refunded back to that user's account or wallet.

Still referring to FIG. 3, at step 312A, either user A may also have the ability to modify the spread or line, or wagered amount, after posting a competition or after users B and C have joined. For example, in such a scenario, either of users B or C may request user A to modify or change his or her spread or line for the competition (such as the user's haggling back and forth over reducing or increasing the spread or line by a point or half-point), and in user A doing so, then user B or C will agree to participate in user A's competition. Here, for example, such communication between the users may be provided via a messaging module within the CWE or within one or more groups, among others. In addition, the competitions module can provide the functionality for user A to go back and modify the spread or line, or the wagered amount. Alternatively, user A may grant permission to either of user's B or C to modify the spread or line that was previously set by user A, such as un-locking or making Competition A editable, and then allowing user A to accept or decline the modifications and/or accept or decline to participate in the modified competition.

Still referring to FIG. 3, at step 316, the CWE can monitor the score for competition A in real-time via a third-party source. In particular, the CWE can integrate with a third-party database, servers, or source that can transmit live or real-time competition data to the CWE. Here, the third-party database source, such as SPORTRADAR®, may include an Application Programming Interface (API) that can integrate with the CWE, or via an API of the CWE. Here, the CWE can be configured to receive or request streaming data from the third-party source continuously or at various intervals, such as every second, minute, 15-minute, hourly, daily, or weekly intervals, among others. Here, such requests can be via one or more API calls to the third-party source. For example, such feeds to the CWE system can include any one or more of the following that pertain to any one or more competitions within the CWE: primary feeds such as daily schedule, daily change log, daily transfers, league leaders, schedule, series schedule, rankings standings; game feeds such as game box score, game summary, game commentary, game color analysis, play-by-plays; player feeds such as player or competitor profile; team feeds such as seasonal statistics, series statistics, game splits, hierarchy splits, in-game splits, schedule splits, team profiles; additional fees such as injuries, league hierarchy, free agents; and push fees such as push clock, push events, and push statistics, among other types of feeds.

Still referring to FIG. 3, the CWE may be configured to receive any one or more of the aforementioned feeds pertinent to any type of competition, team, league, or contest. In addition, each user of the CWE may set custom preferences for receiving any of the one or more feeds, data, or statistics associated with preferred competitions, games, or sport leagues. For example, user A may be able to evaluate such API feed data to determine or calculate an appropriate point spread or line prediction for a particular upcoming competition that user A wishes to create, join, or participate. Similarly, any of users B or C may also evaluate such data, such as various statistics, pertinent to an upcoming competition that he or she may want to participate in, to determining the odds or chances of the user winning the prediction for a competition. In other words, the CWE can provide a game of skills-based wagering system wherein each user can skillfully place his or her wager in a competition depending on various types of analyzed data, historical data, commentary, trends, analysis, experience, and predictable forecast.

Still referring to FIG. 3, at step 318, the CWE can determine an appropriate winner, loser, or draw for competition A. Specifically, once the CWE receives one or more data feeds, such as a final score for competition A, the CWE can then automatically calculate and determine based on the received data if any or all of users A, B, and C for competition A are to be deemed winners or losers for competition A. Specifically, such determination is dependent on the pre-defined spread or line set by user A for competition A. Upon determining the winner(s) or loser(s), then at step 320, the CWE can either credit or deduct a monetary amount or token of value to or from an account or wallet connected to any or all of users A, B, and C.

Figure 4:
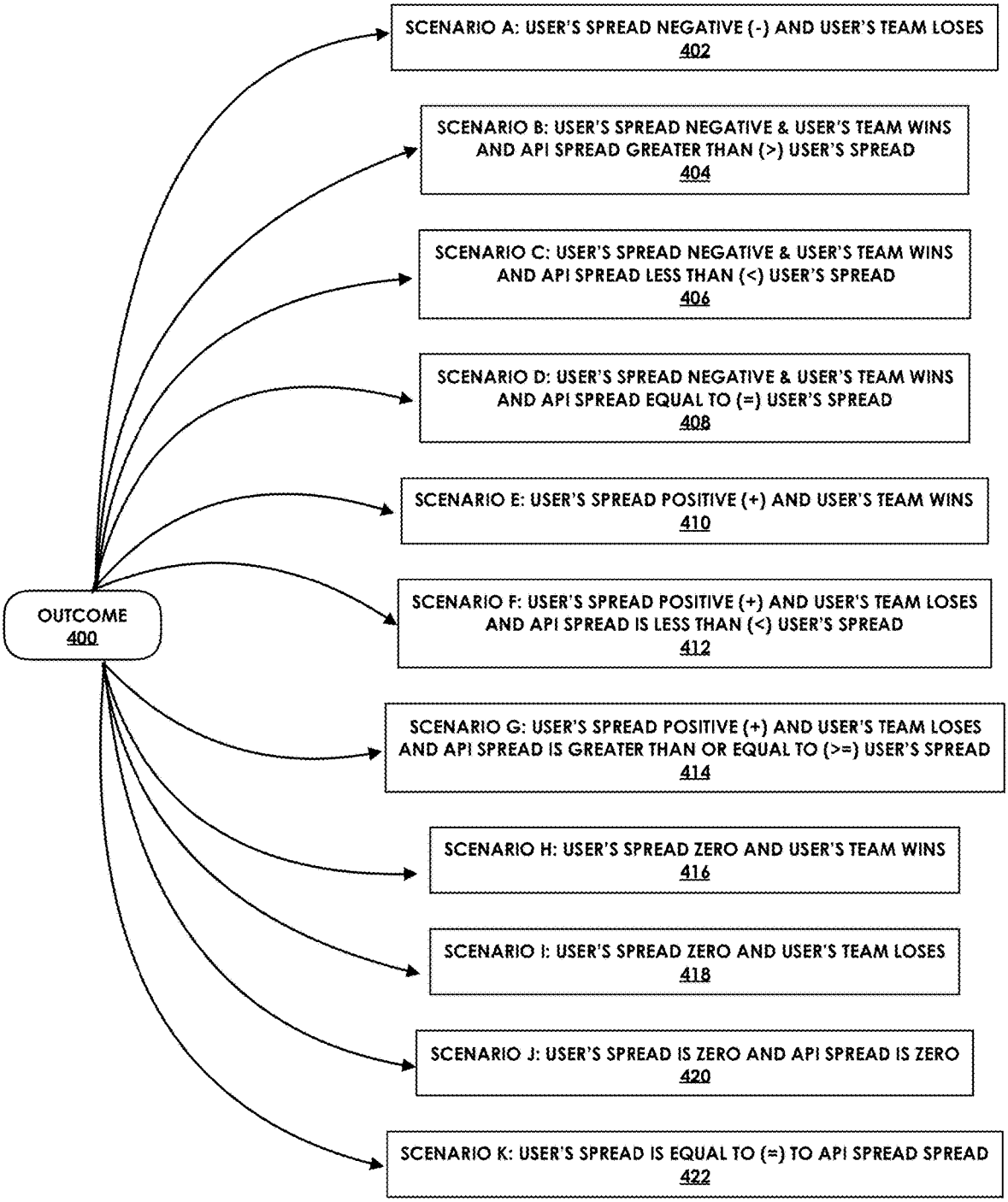
FIG. 4 illustrates a block diagram for various outcome scenarios of the CWE according to one non-limiting exemplary embodiment of the disclosure described herein.

FIG. 4 illustrates one non-limiting exemplary embodiment for various potential outcomes 400 for particular competition, such as competition A, and a decision process associated with that outcome per the CWE on which user, if any, to be credited with an amount (or deduct an amount) for a particular competition. Here, at outcome 402, scenario A can include wherein user A's spread or line has a negative (−) value and the user's team or side in the competition loses. In such a scenario, user A loses and user A will have lost (or be unable to recover) the previously contributed or placed monetary amount or token of value, or alternatively, the user is not credited or awarded for the competition. For example, the competition can be between team X and team Y. Here, user A can select or set team X at −1 (negative one), which equates to team X winning the competition by a score of more than one (1). If the result from the third-party source data feed or API received by the CWE comes as team X with a score of 2 and team Y with a score of 3, then user A's team X will have lost the competition and user A declared a loser, with no monetary amount or token of value credited to user A's account or wallet.

Still referring to FIG. 4, at outcome 404, scenario B can include wherein user A's defined spread or line has a negative (−) value and user A's team wins and the third-party source data feed spread or line is greater than user A's spread or line. In such a scenario, user A wins and the calculated winning monetary amount or token of value is credited to the user's account or wallet. For example, the competition can be between team X and team Y. Here, user A can select or set team X at −1, which equates to team X winning the competition by a score of more than one (1). If the result from the third-part source data feed received or API received by the CWE comes as team X with a score of 5 and team Y with a score of 3, then user A's team X will have won the competition and user A declared a winner, with the calculated monetary amount or token of value credited to user A's account or wallet.

Still referring to FIG. 4, at outcome 406, scenario C can include wherein user A's defined spread or line has a negative (−) value and user A's team wins and the third-party data source data feed spread or line is less than user A's spread or line. In such a scenario, user A loses and user A will have lost (or be unable to recover) the previously contributed, wagered, or placed monetary amount or token of value, or alternatively, the user is not credited or awarded for the competition. For example, the competition can be between team X and team Y. Here, if user A can select or set team X at −2, which equates to team X winning the competition by a score of more than two (2). If the result from the third-party data feed received or API received by the CWE comes at team X with a score of 5 and team Y with a score of 4, then the competition will be determined to be a draw and the condition of user A will be set to false, and the owner will be declared a loser, with no monetary amount or token of value credited to user A's account or wallet.

Still referring to FIG. 4, at outcome 408, scenario D can include wherein user A's defined spread or line has a negative (−) value and the user's team wins and the third-party data source spread or line is equal to the user's spread or line. In such a scenario, the competition is a draw. For example, the competition can be between team X and Y. Here, user A selects or sets team X at −1, which equates to team X winning by score of more than one (1). If the result from the third-party data feed received or API received by the CWE comes at team X with a score of 3 and team Y with a score of 2, then user A's team's will have won the competition by one (1) point and the competition will be declared drawn. For example, the competition can be between team X and team Y. Here, user A can select or set team X at −1, which equates to the team X winning the competition by a score of more than one (1). Here, if the result from the third-party source data feed received or API received by the CWE comes as team X with a score of 3 and team Y with a score of 2, then user A's team X will have won the competition but the competition will be declared as drawn.

Still referring to FIG. 4, at outcome 410, scenario E can include wherein user A's spread or line is positive (+) and the user's team wins. In such a scenario, user A wins and the calculated winning monetary amount or token of value is credited to the user's account or wallet. For example, the competition can be between team X and team Y. Here, user A can select or set team X at +1, which equates to team X winning or losing by less than one (1). If the result from the third-party source data feed received or API received by the CWE comes as team X with a score of 3 and team Y with a score of 2, then user A will have won the competition and user A declared winner of the competition, with the calculated monetary mount or token of value credited to user A's account or wallet.

Still referring to FIG. 4, at outcome 412, scenario F can include wherein user A's spread or line is positive (+) and the user's team loses and the received third party data source spread or line is less than user A's spread or line. In such a scenario, user A wins and the calculated winning monetary amount or token of value is credited to the user's account or wallet. For example, the competition can be between team X and team Y. Here, user A can select or set team X at +2, which equates to team X winning or losing the competition by a score of less than two (2). If the result from the third-party data feed received or API received by the CWE comes as team X with a score of 2 and team Y with a score of 3, then user A's team will have lost the competition by less than two (2) points and user A will be declared as winner of the competition, with the calculated monetary amount or token of value credited to user A's account or wallet.

Still referring to FIG. 4, at outcome 414, scenario G can include wherein user A's spread or line is positive (+) and the user's team loses and the third-party data source spread or line is greater than or equal to user A's spread or line. In such a scenario, user A loses and user A will have lost (or be unable to recover) the previously contributed or placed monetary amount or token of value, or alternatively, the user is not credited or awarded for the competition. For example, the competition can be between team X and team Y. Here, user A can select or set team X at +2, which equates to team X winning or losing by less than two (2). If the result from the third-party data feed received or API received by the CWE comes as team X with a score of 3 and team Y with a score of 6, then user A's team X will have lost the competition by three (3) points and user A's condition set to false and user A will be declared as a loser of the competition. Here, no monetary amount or token of value will be credited to user A's account or wallet.

Still referring to FIG. 4, at outcome 416, scenario H can include wherein user A's spread or line is selected or set to zero (0) and the user's team wins. In such a scenario, user A wins and the calculated winning monetary amount or token of value is credited to the user's account or wallet. For example, the competition can be between team X and team Y. Here, user A can select or set team X at zero (0), which equates to team X winning the competition. If the result from the third-party source data feed received or API received by the CWE comes as team X with a score of 3 and team Y with a score of 2, then user A's team X will have won the competition and user A will be declared as winner. Here, the calculated monetary amount or token of value will be credited to user A's account or wallet.

Still referring to FIG. 4, at outcome 418, scenario I can include wherein user A's spread or line is selected or set at zero (0) and the user's team loses. In such a scenario, user A loses and user A will have lost (or be unable to recover) the previously contributed or placed monetary amount or token of value, or alternatively, the user is not credited or awarded for the competition. For example, the competition can be between team X and team Y. Here, user A can select or set team X at zero (0), which equates to team X winning the competition. If the result from the third-party source data feed received or API received by the CWE comes as team X with a score of 2 and team Y with a score of 3, then user A's team X will have lost the competition and user A's condition set to false and the user A declared as loser of the competition. Here, no monetary amount or token of value will be credited to user A's account or wallet.

Still referring to FIG. 4, at outcome 420, scenario J can include wherein user A's spread or line is selected or set to zero (0) and the third-party data source spread is also zero (0). In such a scenario, the competition will be considered a draw. For example, competition can be between team X and team Y. Here, user A can select or set team X at zero (0), which equates to team X winning the competition. If the result from the third-party source data feed received or API received by the CWE comes as team X with a score of 3 and team Y with a score 3, then the competition will be declared a draw and with the user's spread set at zero then the competition will be marked as drawn.

Still referring to FIG. 4, at outcome 420, scenario K can include wherein user A's spread or line is selected or set to equal to the spread from the third-party source data feed. In such a scenario, the competition is declared a draw. For example, the competition is between team X and team Y. Here, user A can select or set team X at +3, which equates to team X winning or losing by less than 3. If the result from the third-party source data feed received or API received by the CWE comes as team X with a score of 3 and team Y with a score of 6, then the competition will be declared as a draw due to the third-party source data feed spread or line being equal to user A's spread or line.

Referring to any of FIGS. 1-25B, the payment structure of the CWE can be customized and set for any type of outcome, such as a win, loss, or draw by one or more users or participants of one or more competitions within the CWE. For example, a first payment structure may include an owner, such as user A, of a posted competition winning the competition. In this owner/win scenario, all amounts associated with each participant/user and amounts associated with owner/users of that competition will be transferred to the owner/user's wallet. Alternatively, a second payment structure can include wherein an owner, such as user A, of a posted competition losing the competition. In this owner/lose scenario, each participant/user will receive, be credited, or be payed doubled their set amount for that competition in their account or wallet. Alternatively, a third payment structure can include wherein there is a draw for a competition. In such a scenario, each owner/user and participant/user can be refunded their contributed or placed amount towards that particular competition, which service fees may either be charged or refunded back. Alternatively, if a competition status is posted, canceled, or suspended, then the competition amounts contributed or placed by each user/owner and user/participant will be refunded back to the user/owner and each user/participant, wherein the service fees may either by charged or also refunded back.

Figure 5:
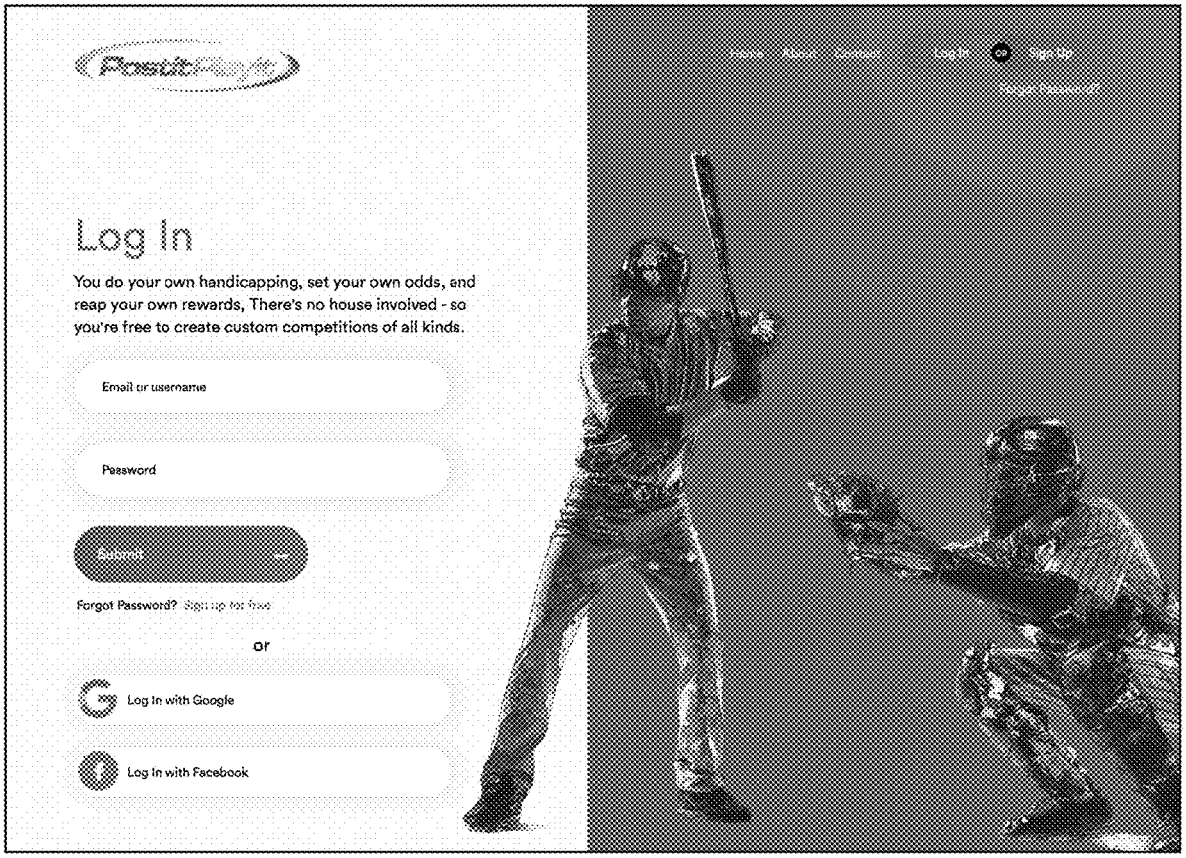
FIGS. 5-17B illustrate various user interface displays for one or more portals of the CWE according to one or more non-limiting exemplary embodiments of the disclosure described herein.
Figure 6:
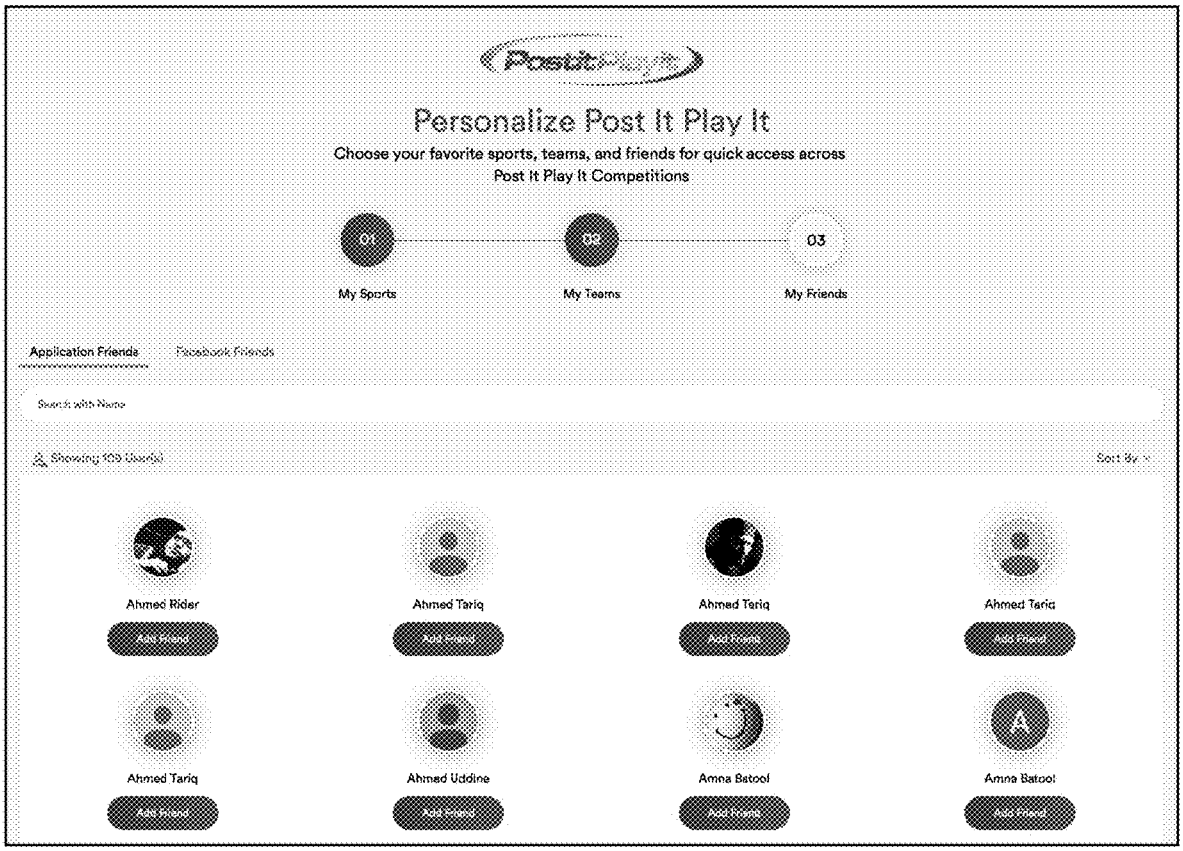
Figure 7A:
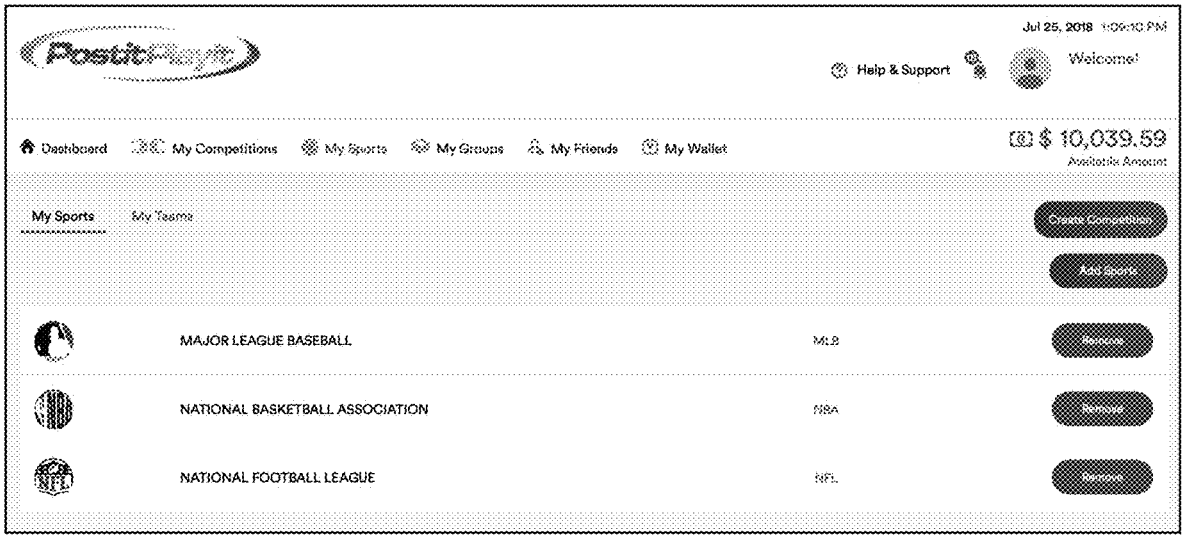
Figure 7B:
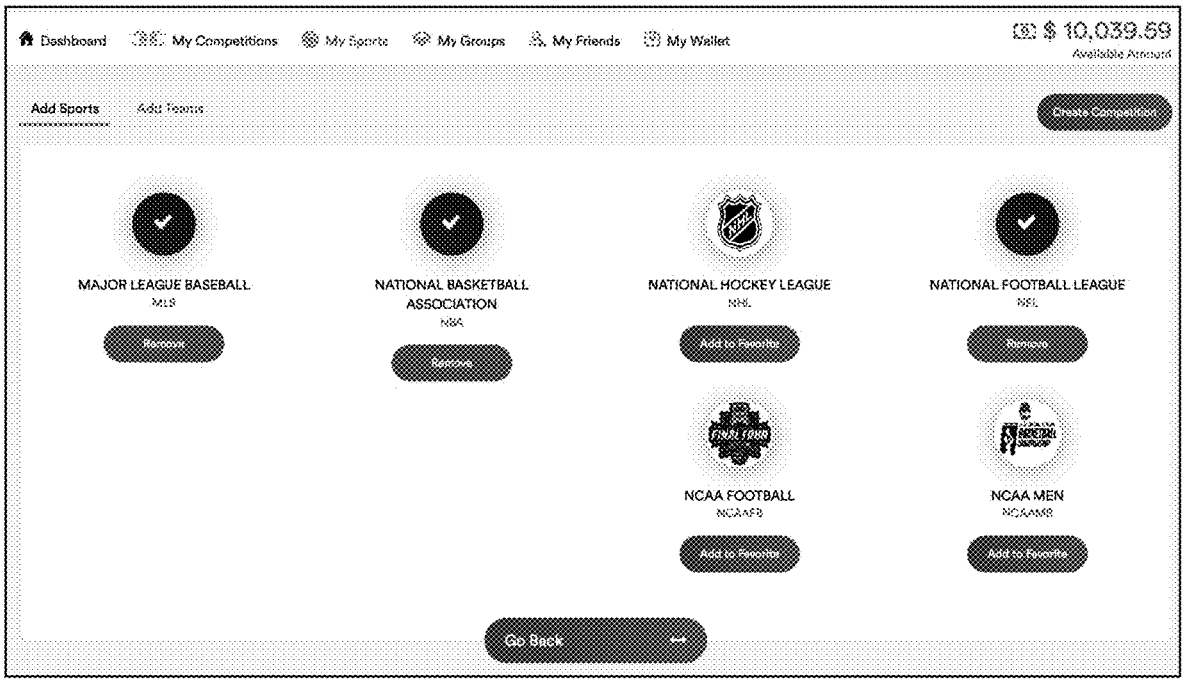
Figure 8A:
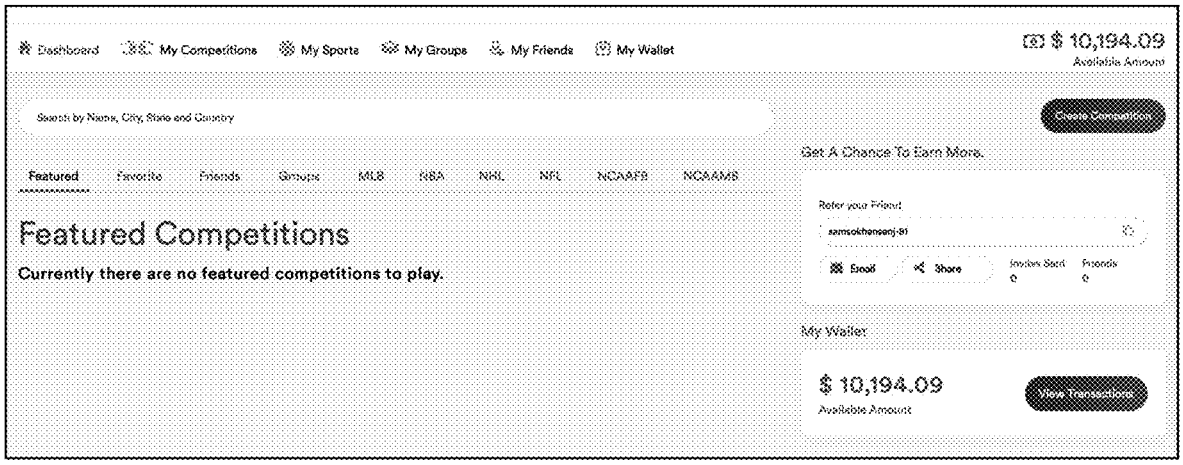

FIGS. 5-17B illustrate various screenshot user interface displays and portals for a computing device for one or more one or more non-limiting exemplary embodiments of the disclosure described herein. In particular, FIG. 5 illustrates a login screen portal for the CWE. FIG. 6 illustrates one non-limiting exemplary embodiment of portal for the user to configure, set up, add/remove, and connect with various friends or contacts who may be a part of third-party social networking websites; or friends or contacts that may be users of the CWE network. FIG. 7A illustrates one non-limiting exemplary embodiment of a portal for configuring and adding/removing various types of sports to the user's account that the user may be interested in posting a competition therein, and FIG. 7B illustrates one non-limiting exemplary embodiment of a portal for the user to configure and add/remove various types of teams to the user's CWE account in which the user may be interested in posting a competition therein. FIG. 8A illustrates on non-limiting exemplary embodiment of a portal for the user to view the featured competitions in which the user may participate or post a competition therein.

Figure 8B:
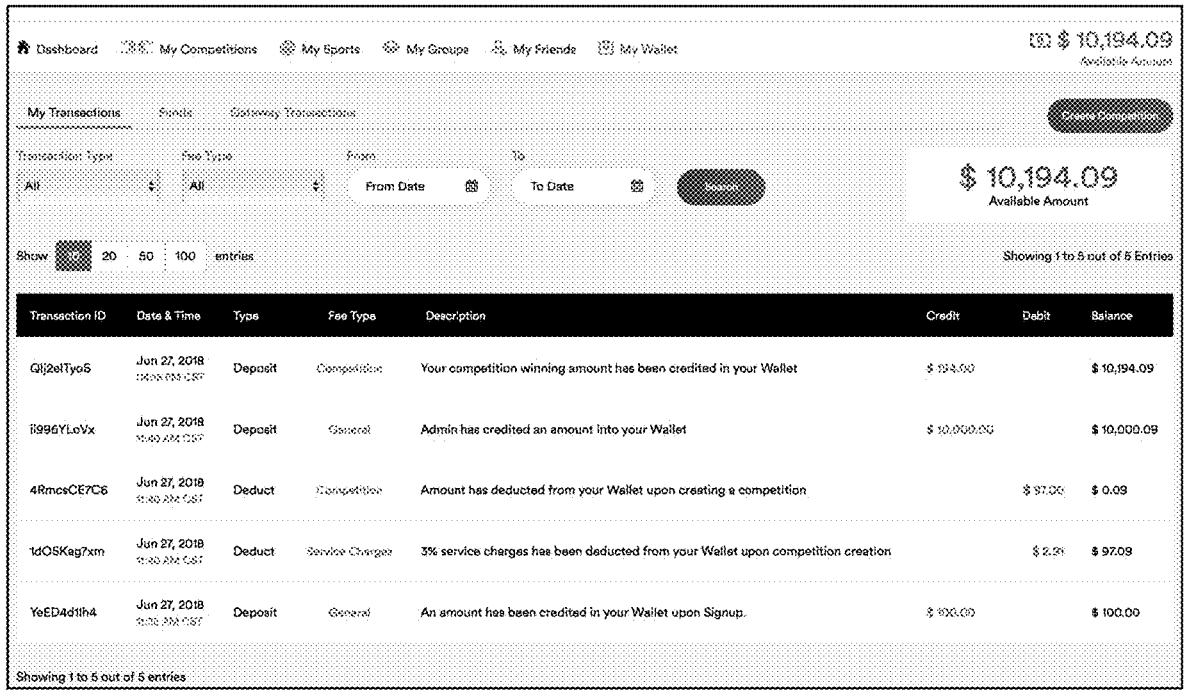
Figure 9A:
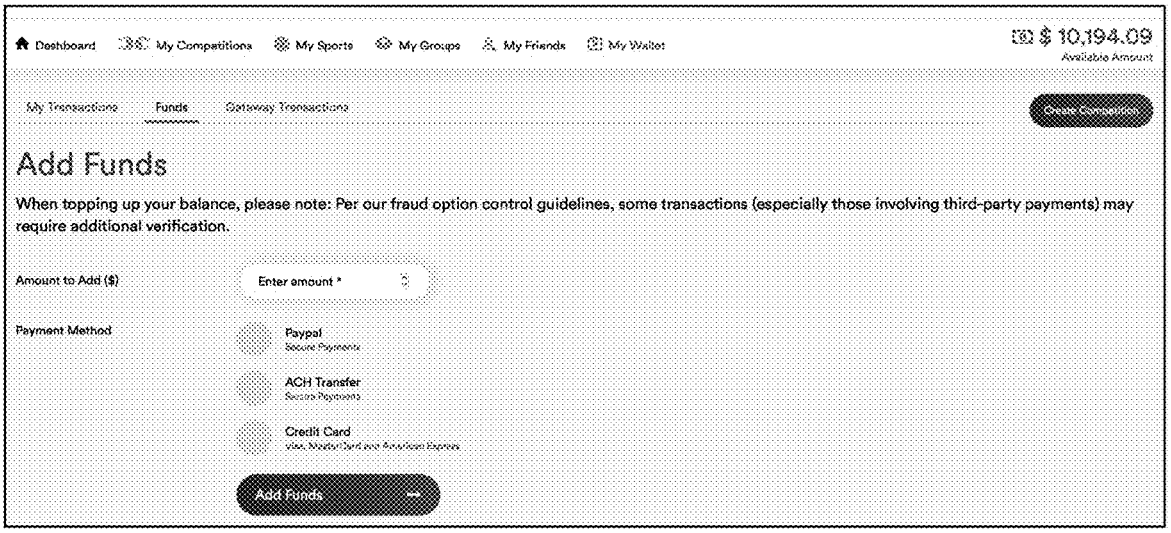
Figure 9B:
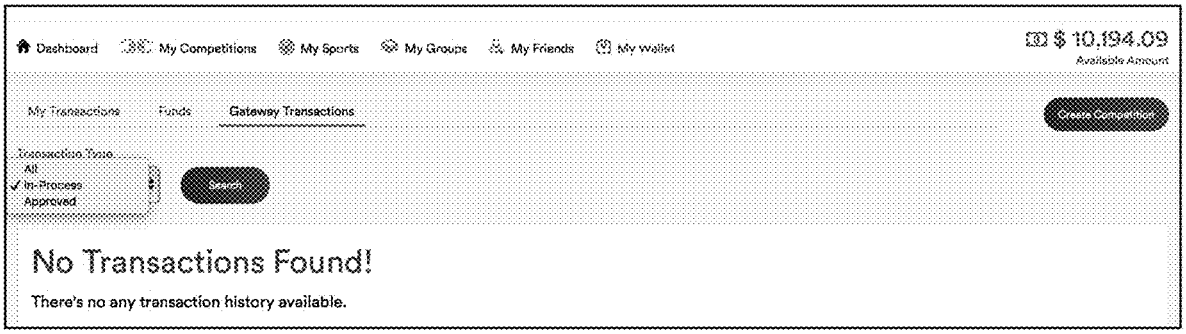

FIG. 8B illustrates non-limiting exemplary embodiment of a "My Transactions" portal for an account or "My Wallet" user interface wherein the user can view all financial transactions pertaining to his or her CWE account, including service fees/charges deducted from the user's account, funds transferred in to or out of the user's account for a winning or losing competition, among others. FIG. 9A illustrates non-limiting exemplary embodiment of a "Funds" portal for adding various types of funds to the user's account within the CWE network. FIG. 9B illustrates non-limiting exemplary embodiment of a "Gateway Transactions" portal for viewing pending, in-process, approved, and/or denied transactions.

Figure 10A:
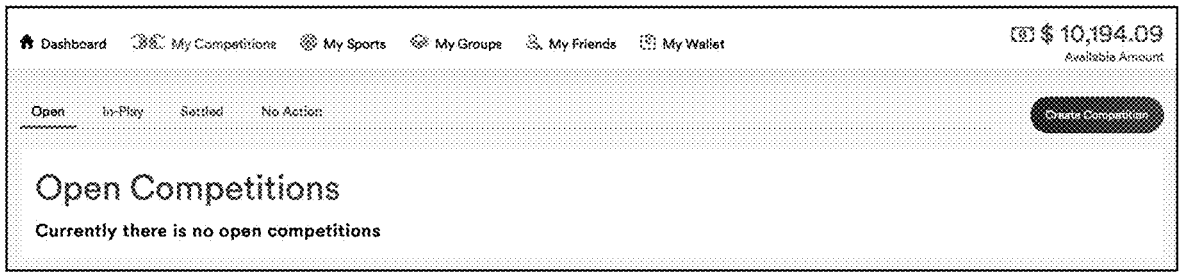
Figure 10B:
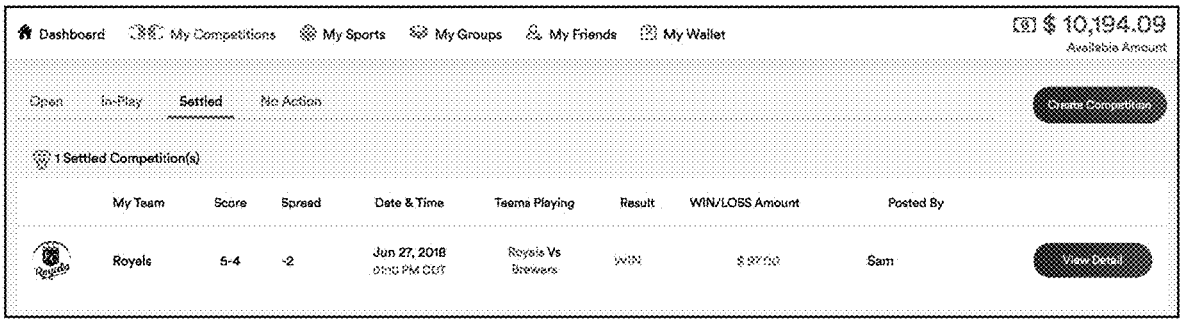
Figure 10C:
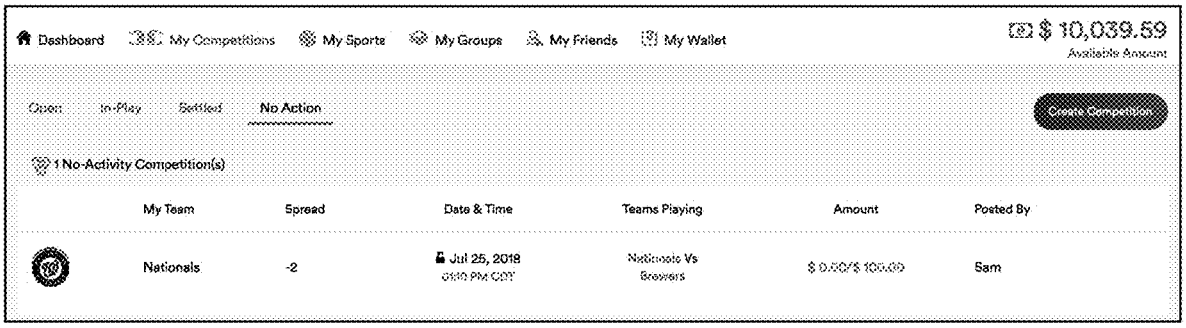

FIG. 10A illustrates one non-limiting exemplary embodiment of a "My Competitions" portal for the user to view current open competitions in which the user has posted a competition therein that is set to begin or pending or for which the user can participate in. FIG. 10B illustrates one non-limiting exemplary embodiment of a portal for settled competitions, including displaying the score, spread, win/loss amount, and the user who posted the competition. FIG. 10C illustrates one non-limiting exemplary embodiment of a portal for viewing the previously posted competitions that have yet to commence.

Figure 11A:
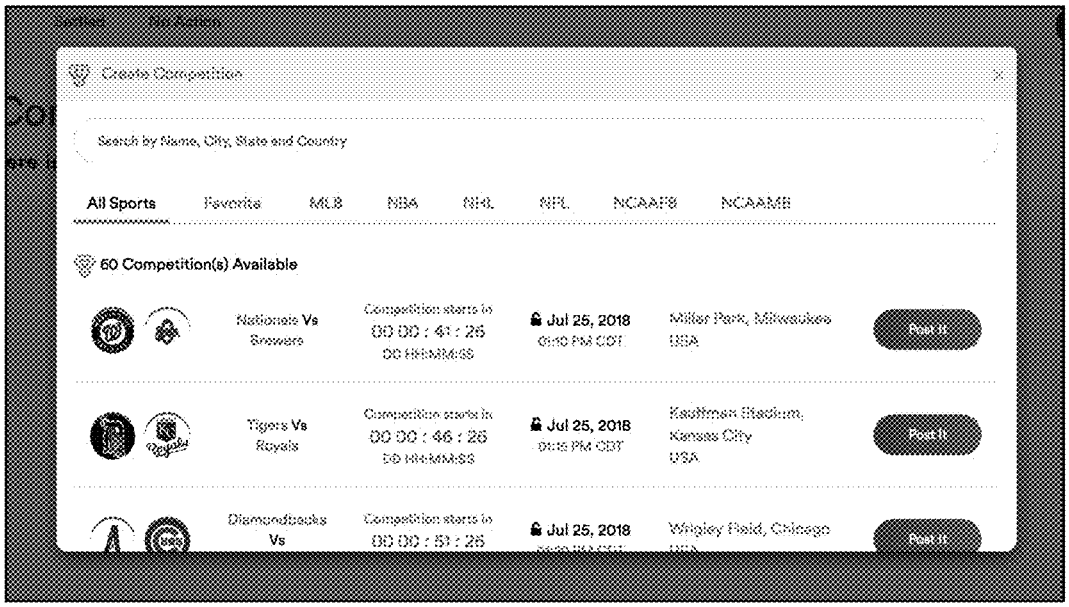
Figure 11B:
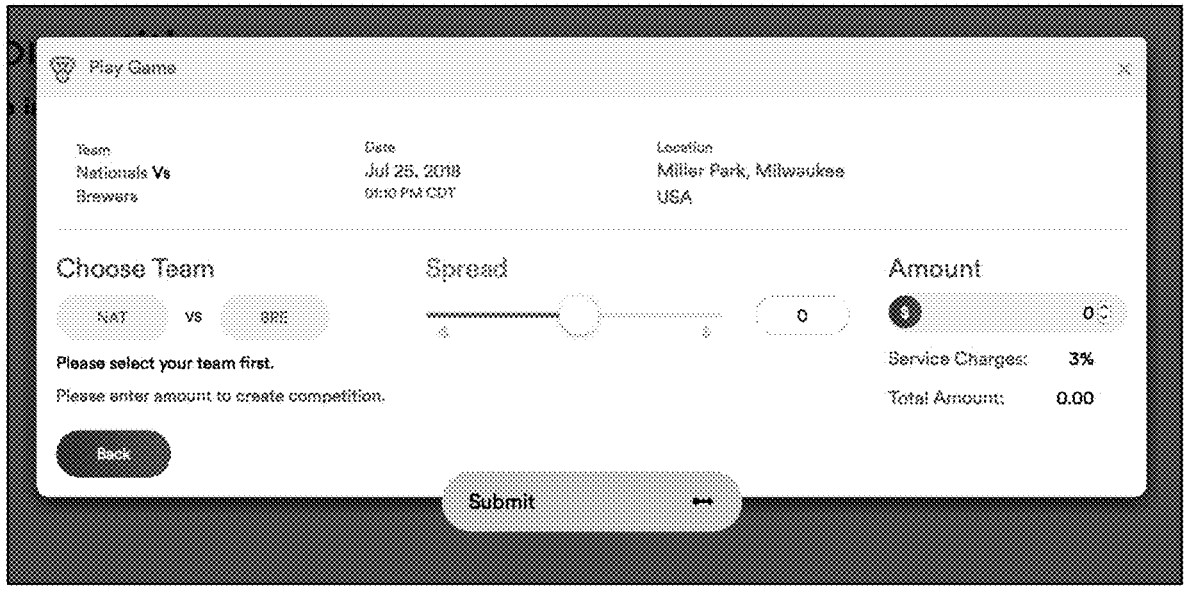
Figure 12A:
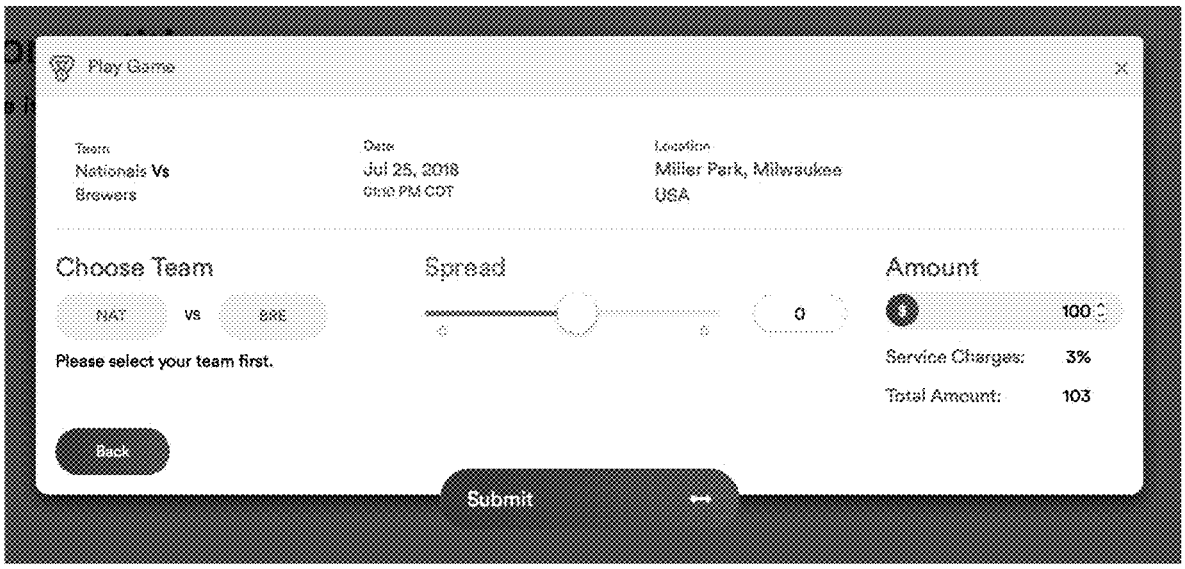
Figure 12B:
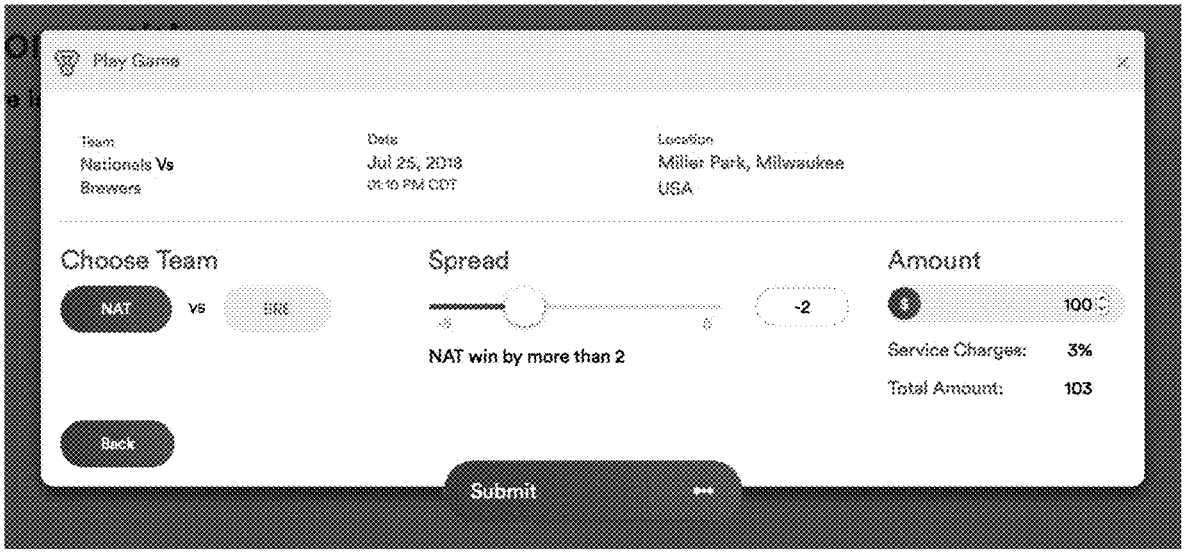

FIG. 11A illustrates one non-limiting exemplary embodiment of a portal for the user to post/create a competition, challenge, campaign or contest within the CWE network. In particular, the user can view the available competitions that the user can participate in, such as displaying competitions based on the user's preferences and prior preferred sports/teams selected. Here, after selecting a "Post it" icon, the user can then be directed to portal illustrated in FIGS. 11B-13A. Here, FIGS. 11B, 12A, 12B, and 13A illustrate non-limiting exemplary embodiments of a portal for the user to customize, configure, and set the point spread/line for the selected competition via the graphical slider, as previously disclosed with respect to FIG. 3. In particular, the user can define his or her wagered amount, select his or her team, and define the spread or line amount by graphically and dynamically moving the graphical slider or track bar element to the left or right. Alternatively, the user may also manually enter the wagered amount. Here, it is contemplated within the scope of the disclosure described herein that any other type graphical user element or icon or user interface element may be used in addition to or in lieu of the graphical spread slider element. In particular, these may include the slider also being configured vertically or in any orientation; input controls such as checkboxes, radio buttons, dropdown lists, list boxes, buttons, toggles, text fields, date field; navigational components such as breadcrumb, search field, pagination, slider, tags, icons; informational components such as tooltips, icons, progress bar, notifications, message boxes, modal windows; and containers such as accordions; tabs; and various control or widget components, among others.

Still referring to FIGS. 11B-13A, the CWE network may further provide suggestions to the user on various aspects of creating the competition. Here, the CWE network may be configured to collect historical and/or tracking data based on one or more users' activities within the CWE network. For example, such data include prior competitions that the user has participated in or posted a competition, including teams that the user won/loss with, prior winning spreads/lines, prior spreads/lines pertaining to certain teams or sports that drew in more or less users and participants for one or more competitions posted by the user, prior wagered amounts, winning or losing history, among others. Here, the CWE network may use any of the aforementioned historical or tracking data to provide certain suggestions, feedback, tips, comments, alerts, or notifications to the user at the time the user is to select a team, wager amount, and define a point spread/line. In addition, it is contemplated within the scope of the disclosure described herein that the CWE network may also track and display to other users or members or third parties any CWE network user or member's tracking data, history, win/loss record, winnings/losses, games/teams/competitions previously participated in, prior defined spreads/lines, or a combination thereof, and further provide a weighted score or rating for each user or member of the CWE network based on the foregoing factors.

Still referring to FIGS. 11B-13A, the CWE network may also receive in real-time current spreads/lines set by one or more third party game operator's or market makers. Here, based on the third-party market maker's predictions, team/player favorite, team/player underdog, and/or the spread/line for a particular upcoming competition, the CWE may automatically and in real-time provide feedback, suggestions, comments, alerts, or notifications to the user who is creating a competition to be posted. More specifically, the CWE network can provide such feedback to the posting user that his or her defined wagered amount and/or defined spread/line for the particular competition may be too much or too low, and may be less or more likely to draw other users or participants to participate in the created competition by the user. Here, the CWE network may automatically compare the user defined spread/line to the third-party market maker's spread/line to provide such feedback. Alternatively, the user may pre-define certain criteria when defining his or her spread/line, wherein such criteria may be to only set the spread/line that is within a range, tolerance, or plus/minus relative to one or more third party market makers' spread/line for the particular competition. Further, the CWE network may publish to the user or keep private from the view of the user the foregoing current third-party makers' predictions or spread/line. Still referring to FIGS. 11B-13A, the user may also have the option to place limit orders or limit wager/spread/line submissions for the CWE network to automatically execute and create/post competitions for the user. For example, the CWE network can execute and create competition based on the user pre-defined criteria or threshold and provide automatic notification to the user or other members of the posted competition. For example, such pre-defined criteria may be based on the types or certain teams/players for an upcoming competition or match, in addition to updated player health/injury conditions/roster/player availability for the upcoming competition or match. Other pre-defined criteria may include the time or location of a particular for an upcoming competition, recent news/press releases pertaining to one or more teams or players in connections to the upcoming competition. Other pre-defined criteria may include the aforementioned third-party market makers' predictions, favorite, underdog, and/or spread/line for the upcoming competition; wherein the pre-defined criteria can include certain pre-defined team/player selections, wagered amounts, thresholds, ranges, or tolerances.

Still referring to FIGS. 11B-13A, the CWE network may also provide suggestions or notifications to a user to join other existing competitions that are similar to a competition that a user is creating or posting. More specifically, in one non-limiting exemplary embodiment, if there is a competition between Team A and Team B, and user A selects Team A and defines a spread/line of −3 and submits the created competition (or prior to final submission), then the CWE network may notify the user of a current existing or open competition similar to the one user A created. More specifically, if another user B has previously selected the same competition between Team A and Team B, and user B selected Team B and defined a spread/line of +3 (i.e., the opposite criteria of user A), then the CWE network can suggest for user A to join user B's posted competition in lieu of user A creating/posting the same competition. Similarly, even if user A and user B both select Team A and define the same spread/line of −3, then the CWE network may still suggest for both users to join the same competition between Team A and Team B. In addition, the CWE network suggestions with respect to the foregoing exemplary embodiments can be notifying user A that user B has X number of users (and the names of the users/user experience level/user history) participating in the competition and display the posted wager amounts such that to incentivize user A to join user B's competition in lieu of creating the same competition.

Figure 13A:
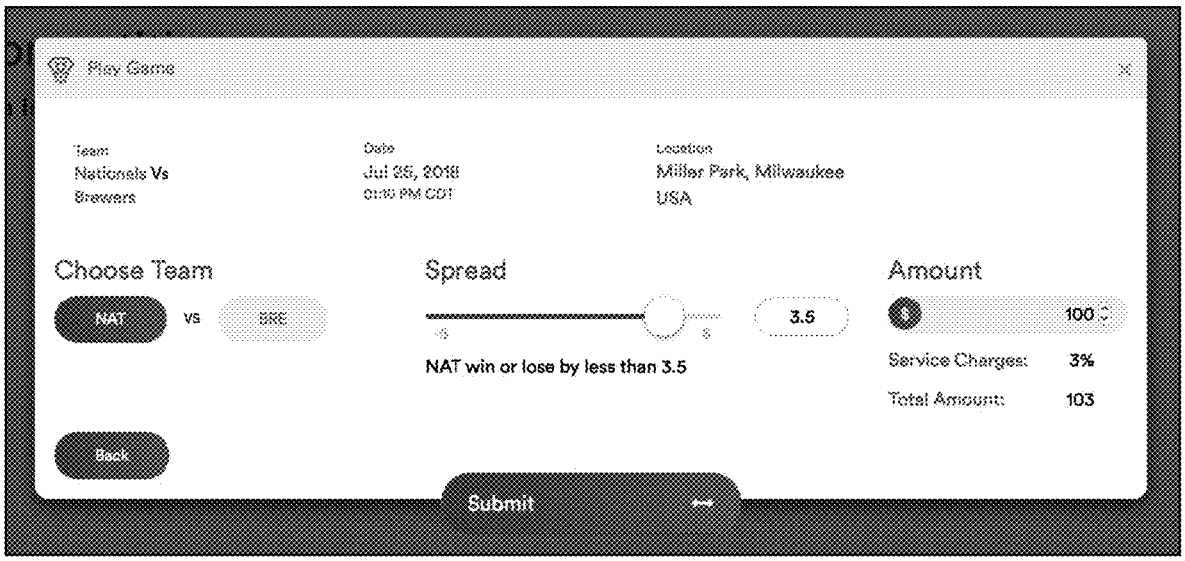
Figure 13B:
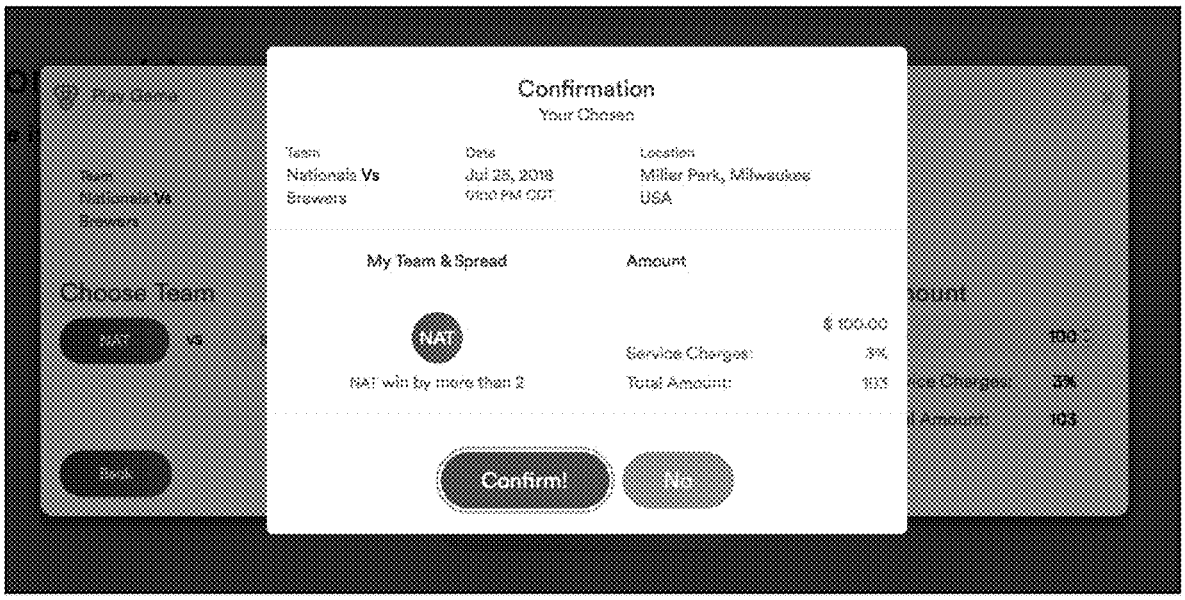
Figure 14A:
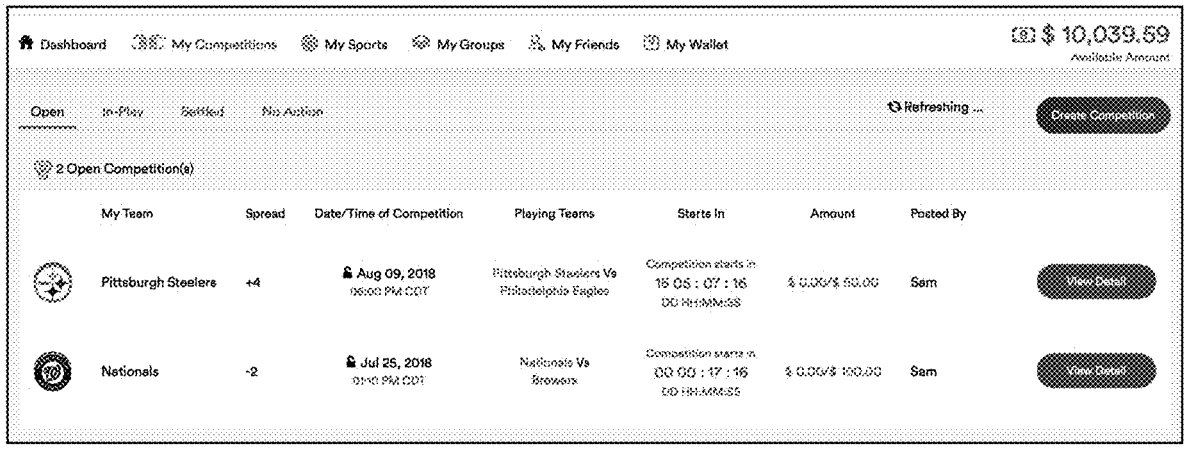
Figure 14B:
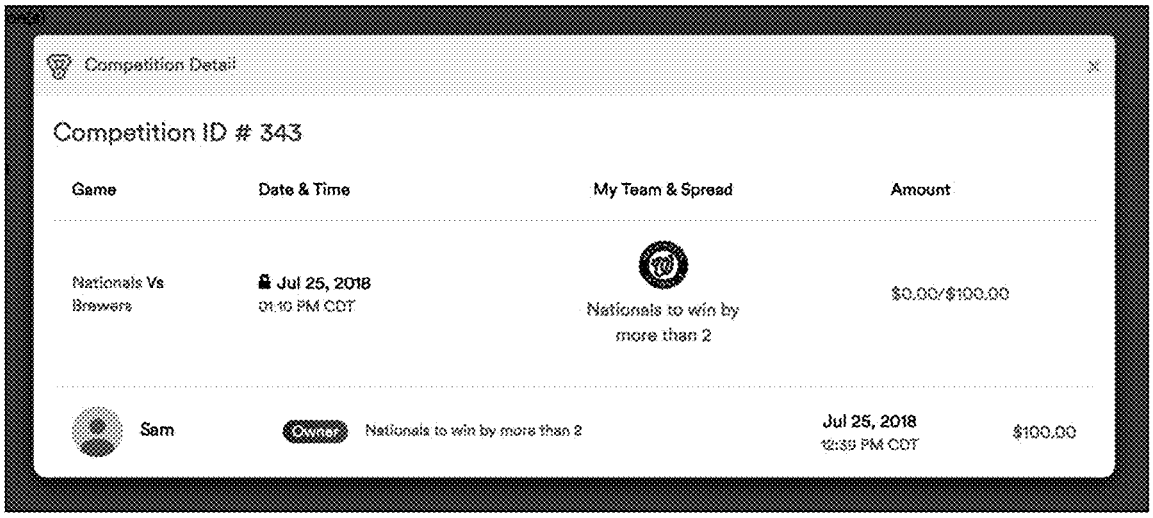

Still referring to FIGS. 11B-13A, after the user has defined his or her spread, team, and wagered amount for the competition, the user can then submit the created competition, which will then direct the user to the confirmation portal of FIG. 13B. After selecting the confirm, the competition will be created/posted within the CWE network for other users to also participate in. FIG. 14A illustrates one non-limiting exemplary embodiment of the "My Competitions" and open competitions portal wherein the user has posted his or her competition, further illustrating the selected team, date/time of competition, starting time, amounts wagered. FIG. 14B illustrates non-limiting exemplary embodiment of a portal wherein the user can view one or more specifics details or properties of a particular competition.

Figure 15A:
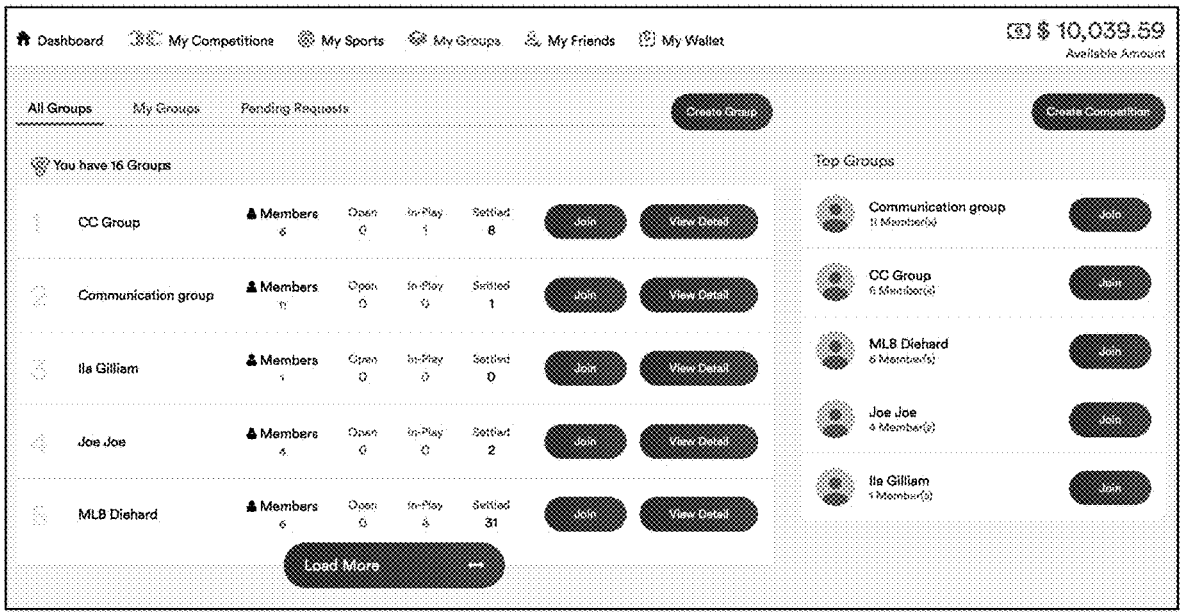
Figure 15B:
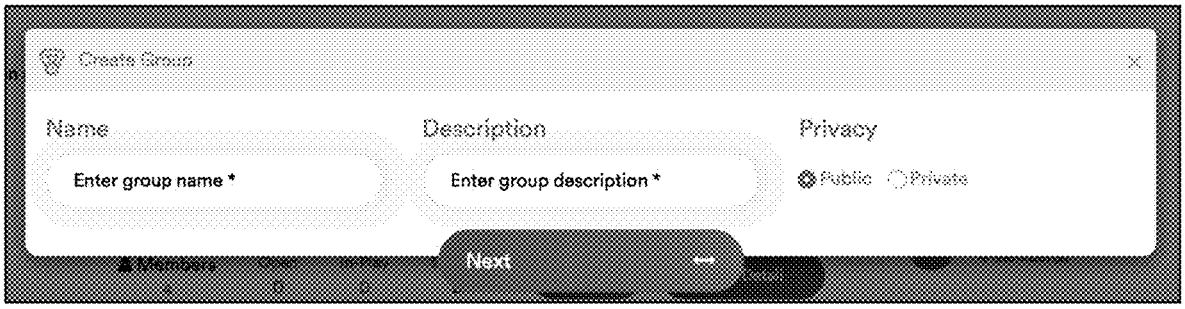
Figure 16A:
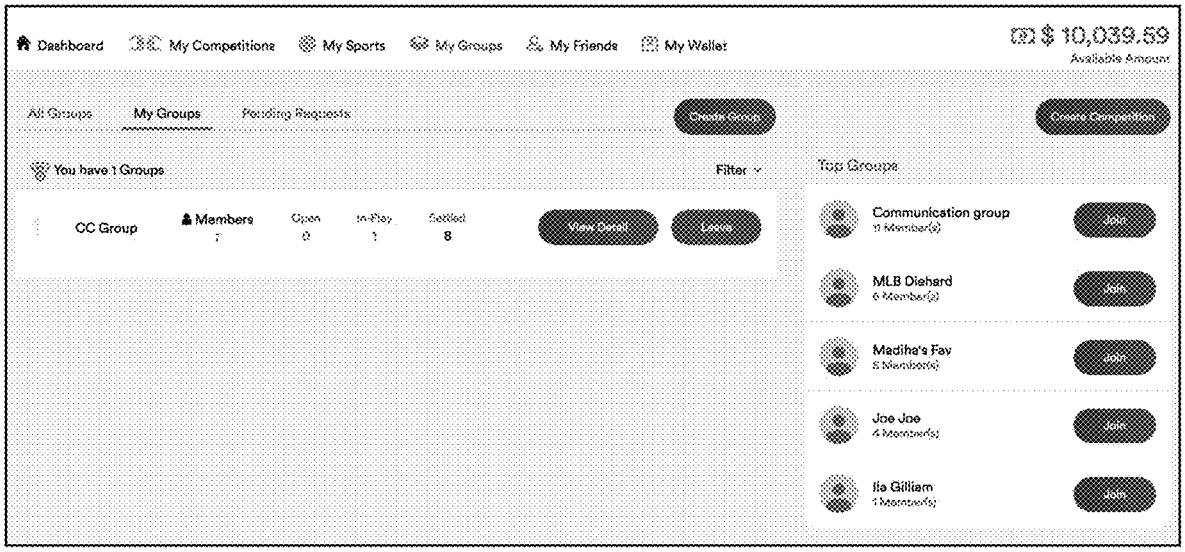
Figure 16B:
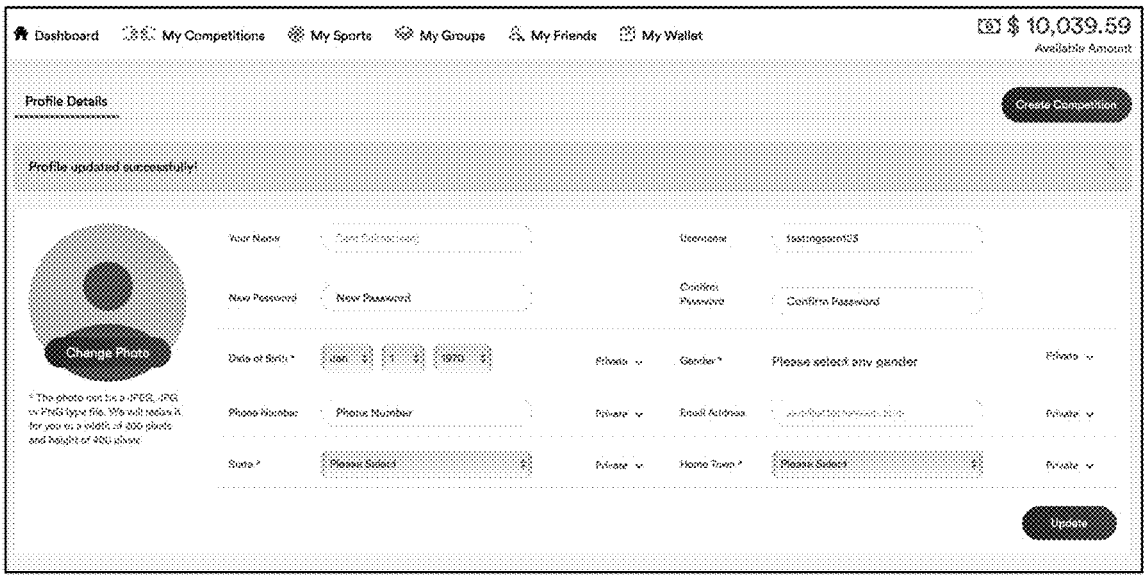

FIG. 15A illustrates one non-limiting exemplary embodiment of a portal for one or more groups within the CWE network. In particular, the portal can illustrate the members/users within the particular group and if there are any open, in-play, or settled competitions associated with the group or individual members/users within the group. In addition, the user may join any one or more groups within the CWE network. FIG. 15B illustrates one non-limiting exemplary embodiment of a portal for creating a group within the CWE network, in which the user may opt to have the group be public or private. In particular, private groups may be limited to the users/members, contacts, or friends or are closely related to one or more users, have received an invitation to join the group, or have prior access privileges to access certain groups or groups created by certain users/members. FIG. 16A illustrates another non-limiting exemplary embodiment of a portal of the CWE network, such as leaving a particular group. FIG. 16B illustrates one non-limiting exemplary embodiment of providing various profile information of the user and allowing the user to customize or configured his or her settings. In particular, the user may further have the option to have certain setting remain public or private.

Figure 17A:
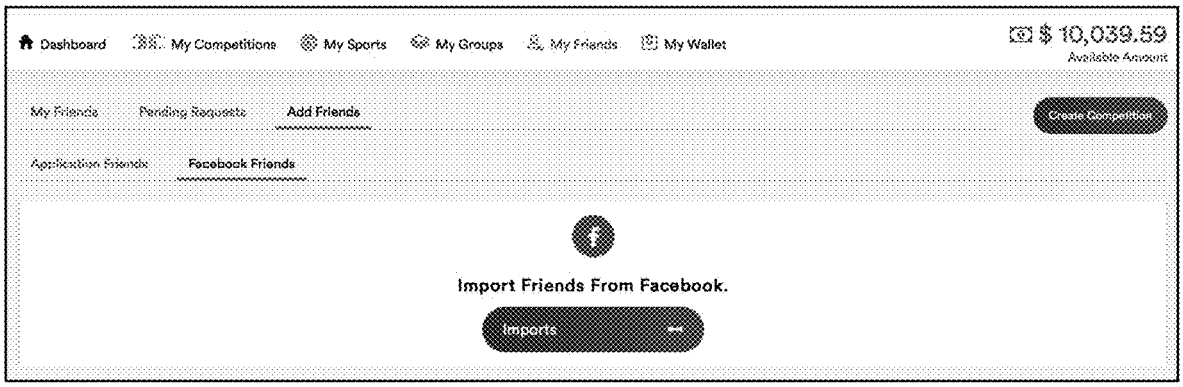
Figure 17B:
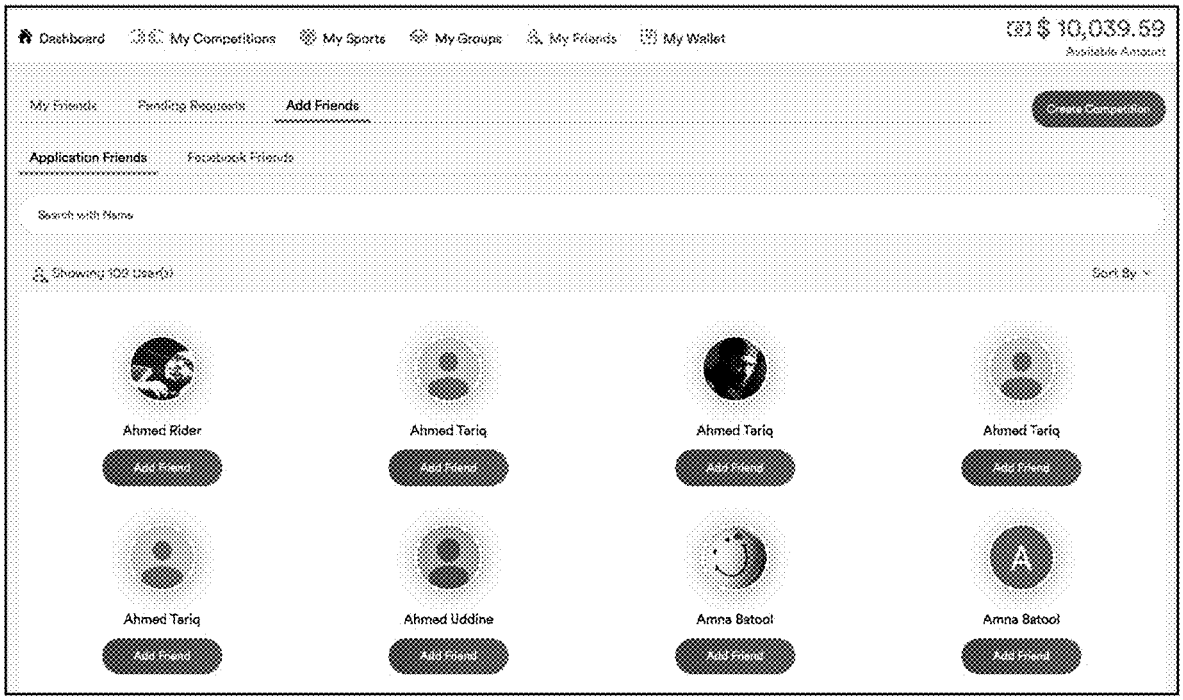

FIG. 17A illustrates one non-limiting exemplary embodiment of a portal for the user to import his or her friends into the CWE network. FIG. 17B allows the user to add various users/members of the CWE network to the user's network.

Figure 18A:
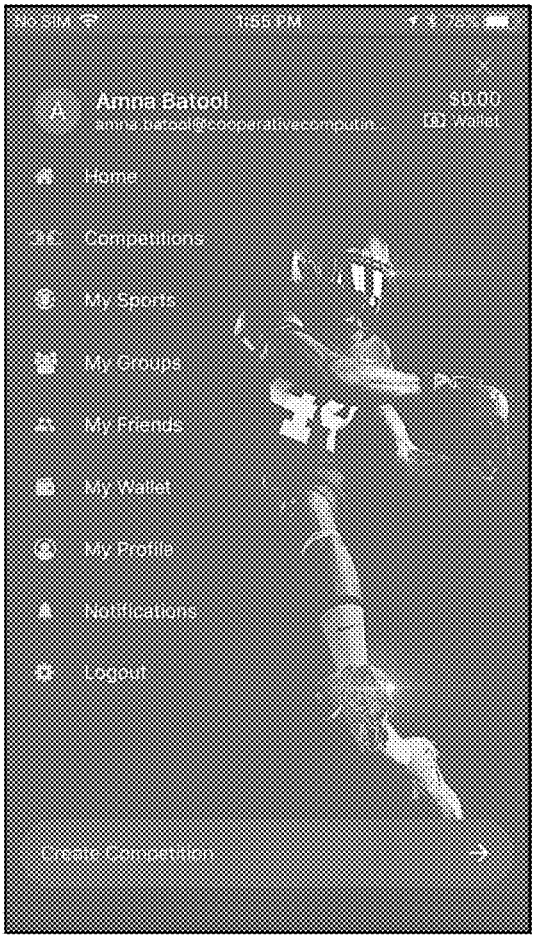
FIGS. 18A-25B illustrate various user interface displays for one or more portals of the CWE on a mobile device according to one or more non-limiting exemplary embodiments of the disclosure described herein.
Figure 18B:
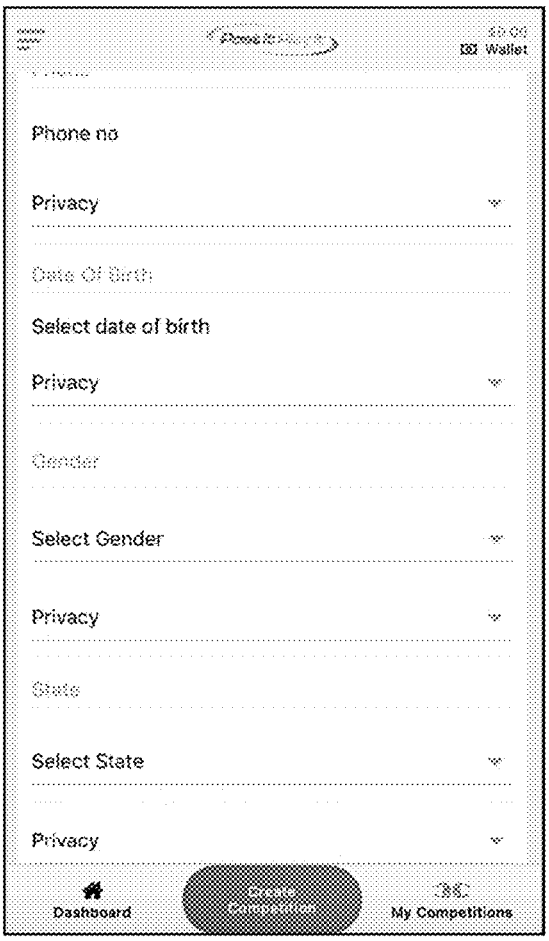
Figure 19A:
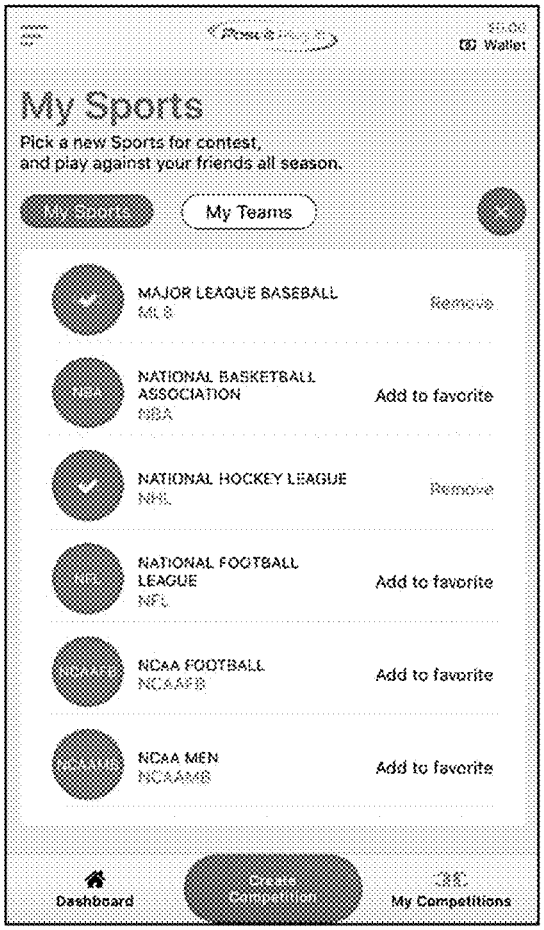
Figure 19B:
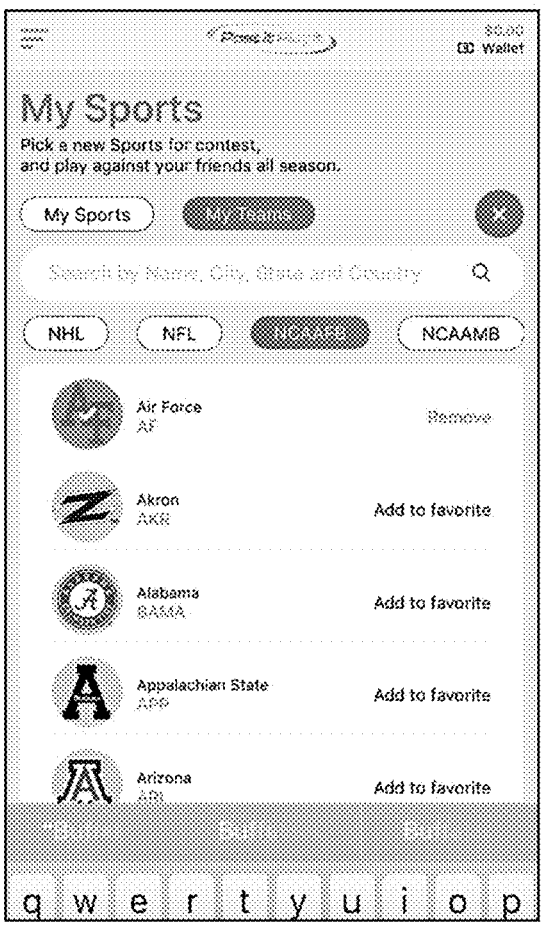
Figure 20A:
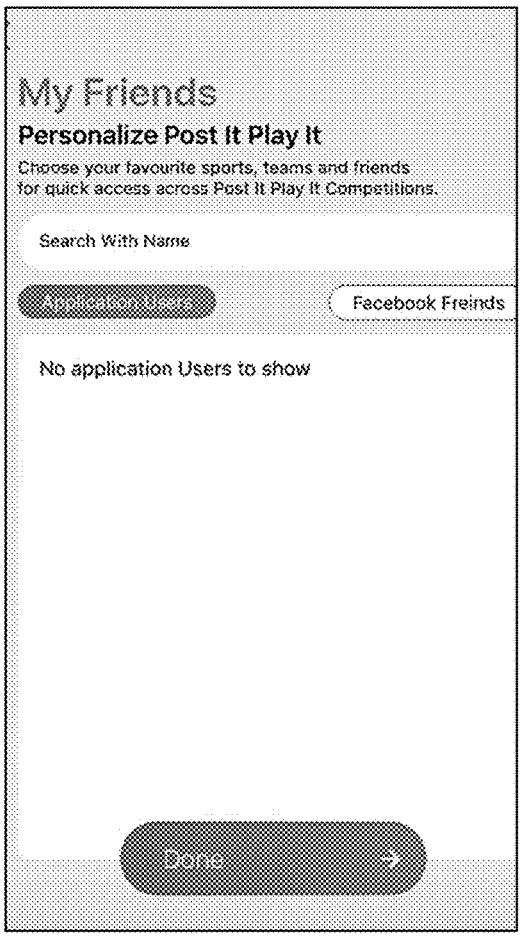
Figure 20B:
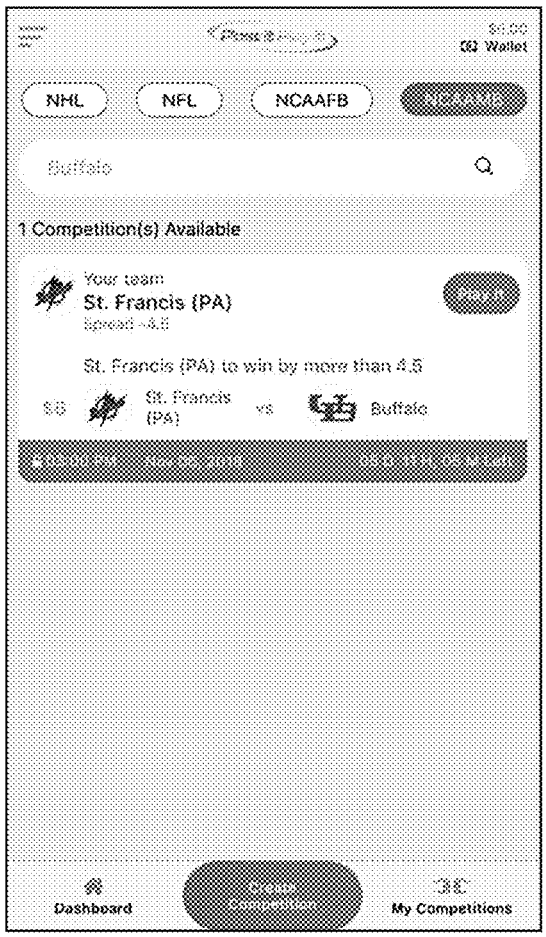
Figure 21A:
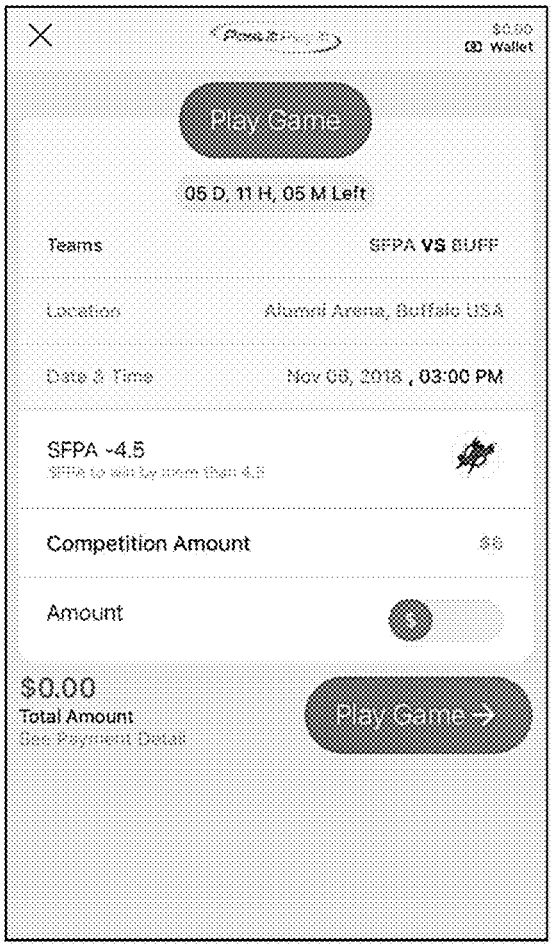
Figure 21B:
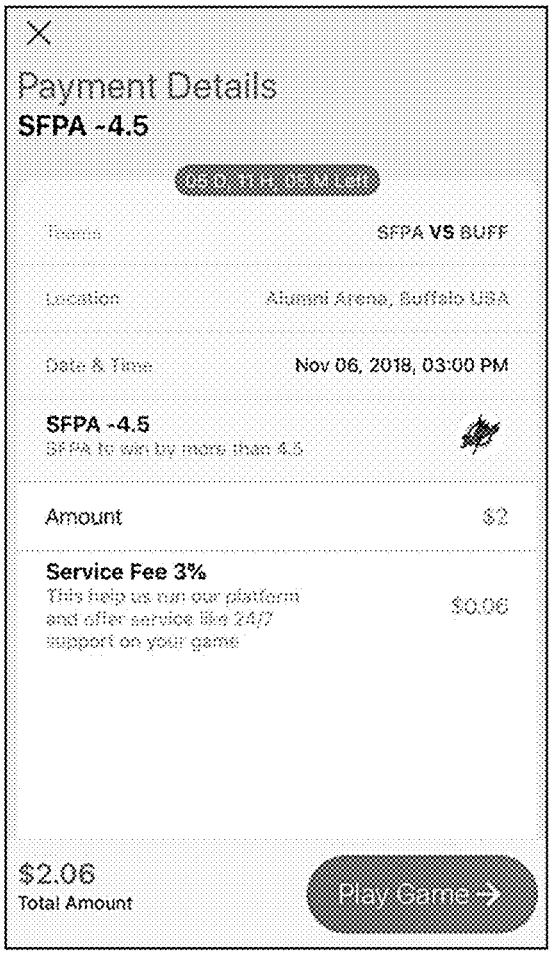
Figure 22A:
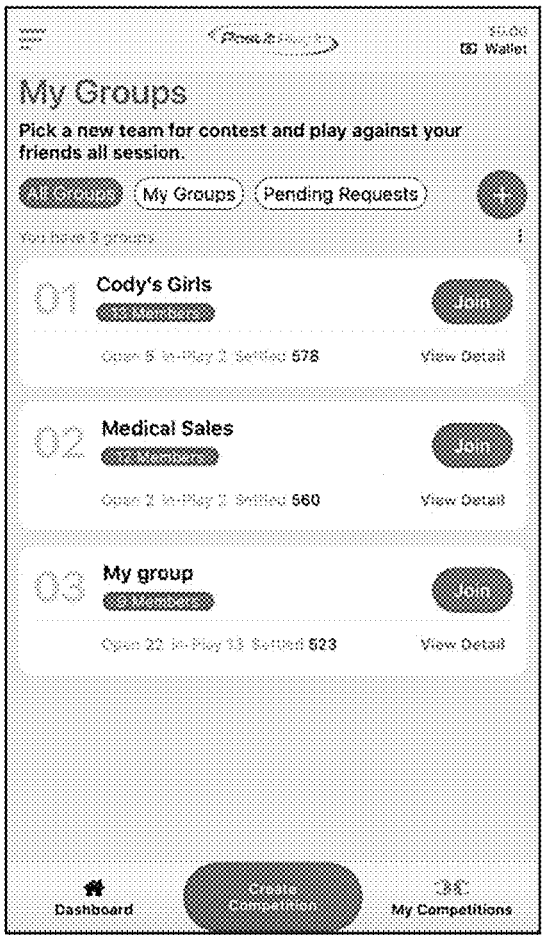
Figure 22B:
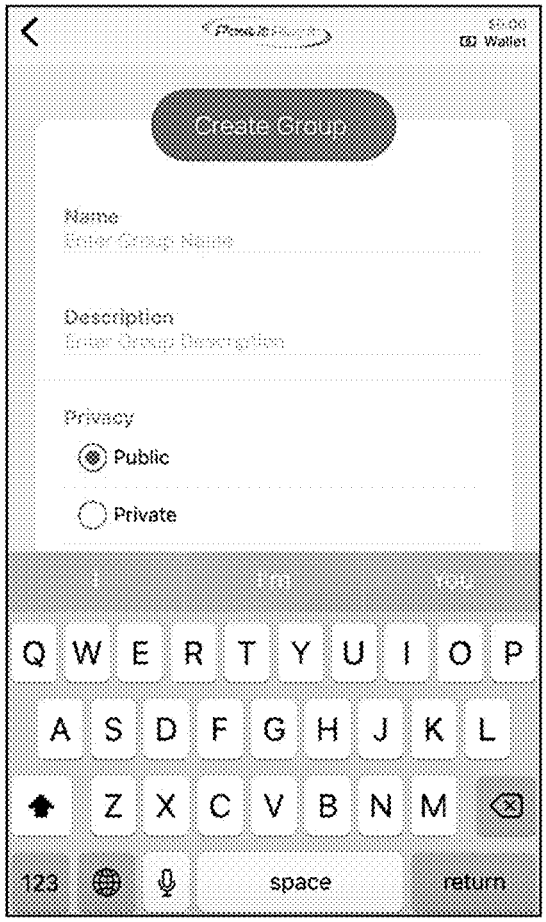

FIGS. 18A-25B illustrate various user interface displays for one or more portals of the CWE on a mobile device according to one or more non-limiting exemplary embodiments of the disclosure described herein. Here, the foregoing discussions and embodiments with respect to FIGS. 1-17B is also applicable with respect to FIGS. 18A-25B and is incorporated herein. In particular, FIG. 18A illustrates one non-limiting exemplary embodiment of a home screen or main dashboard for a portal of the CWE network. FIG. 18B illustrates profile creation for one or more users or members of the CWE network. FIG. 19A-19B illustrate non-limiting exemplary embodiments of a favorites page for selecting one or more leagues, sports, or teams for user to configure the CWE network. FIG. 20A illustrates one non-limiting exemplary embodiment for a user to add friends to his or her CWE network. FIG. 20B illustrates one non-limiting exemplary embodiment of a portal for displaying in upcoming or open game or competition for which the user may create or participate in a competition. Upon selecting "Play It" from FIG. 20B then the user will be taken to FIG. 21A. FIGS. 21A-21B illustrate non-limiting exemplary embodiments of a portal for creating or participating in a competition, wherein the user may set his or her spread/line, wagered amount, and view the service charge for the transaction, among others. FIG. 22A illustrates one non-limiting exemplary embodiment of a My Groups portal for a user to view all public groups, private groups, pending group requests and the ability to join any group within the CWE network, among others. FIG. 22B illustrates one non-limiting exemplary embodiment of a portal for creating a group within the CWE network.

Figure 23A:
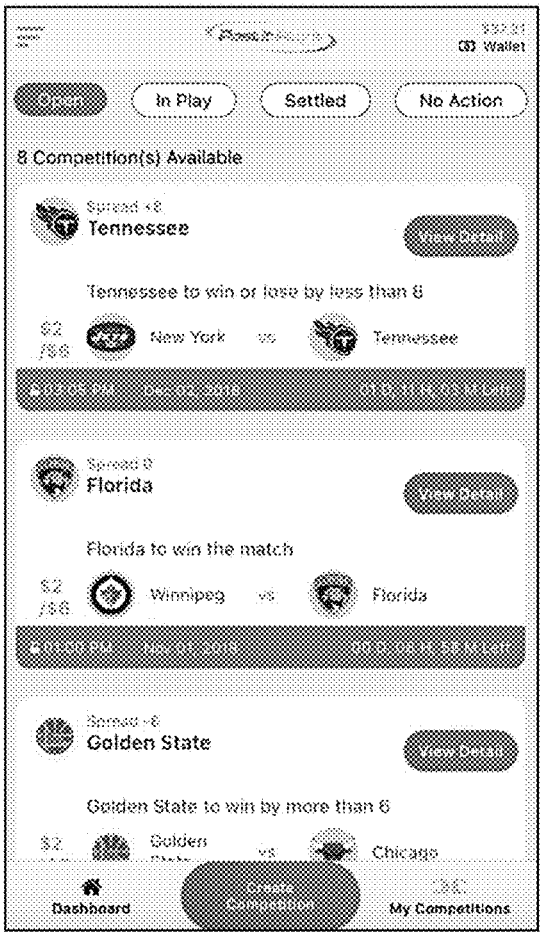
Figure 23B:
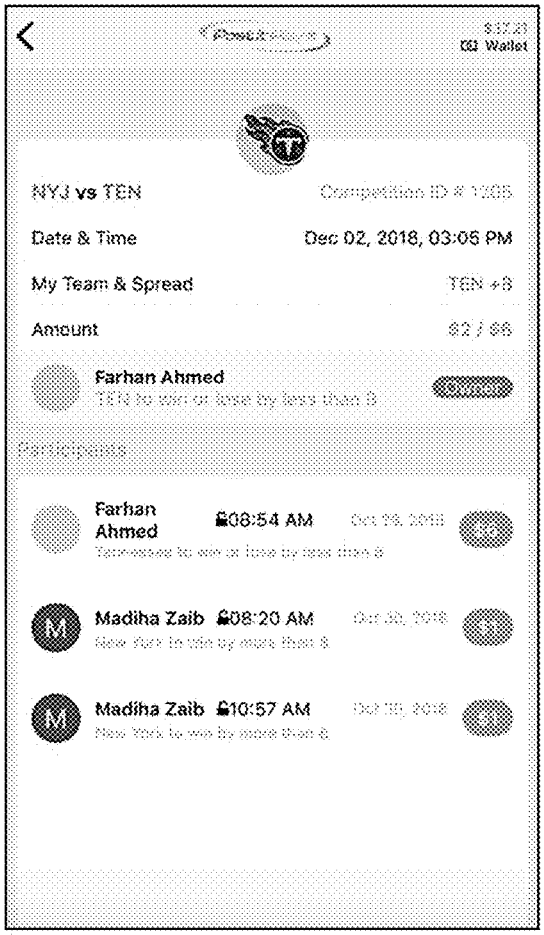
Figure 24A:
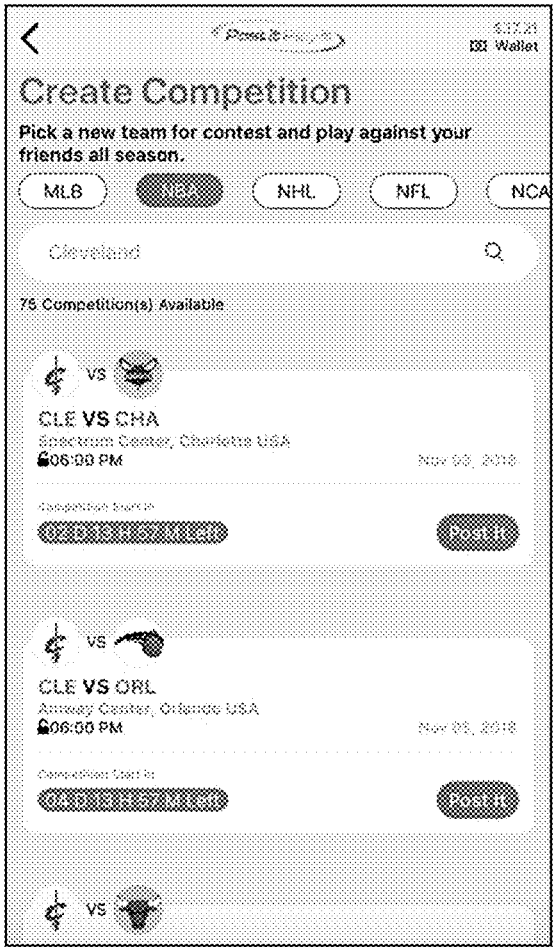
Figure 24B:
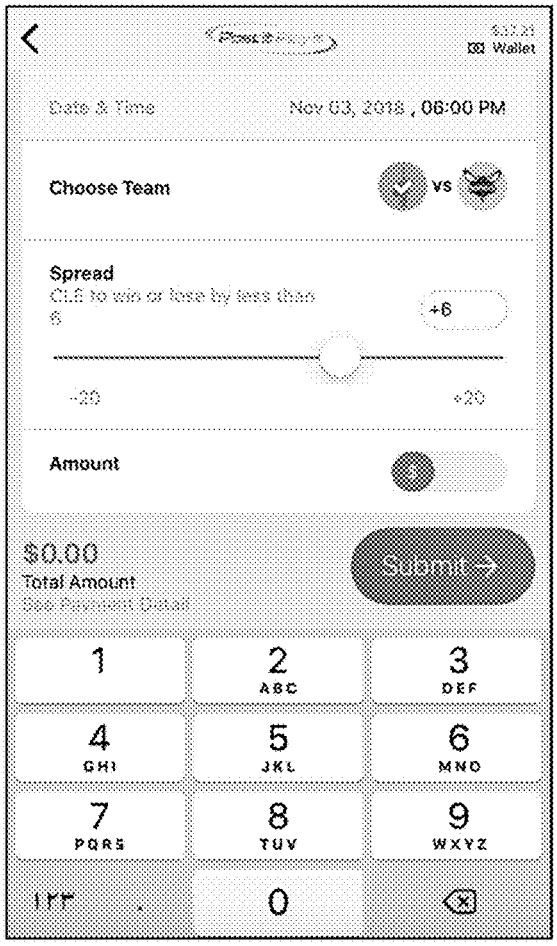
Figure 25A:
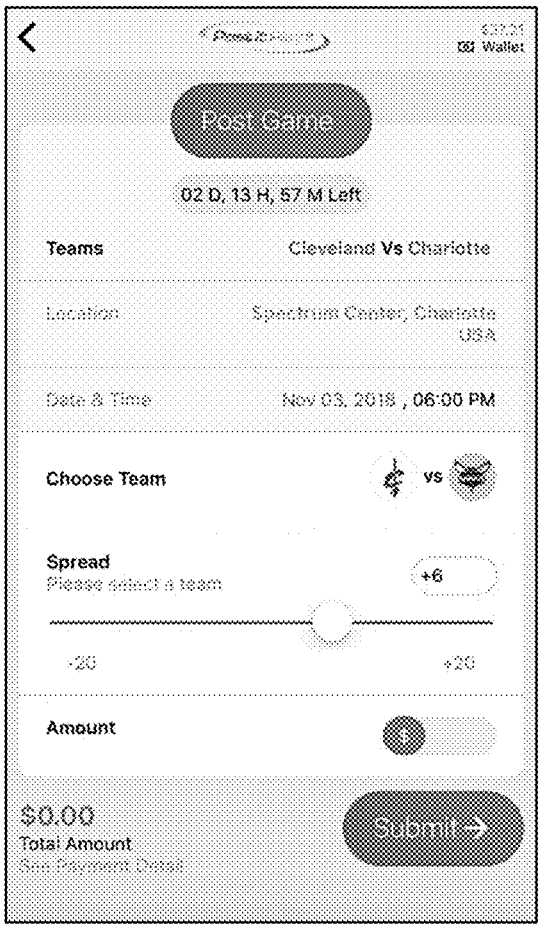
Figure 25B:
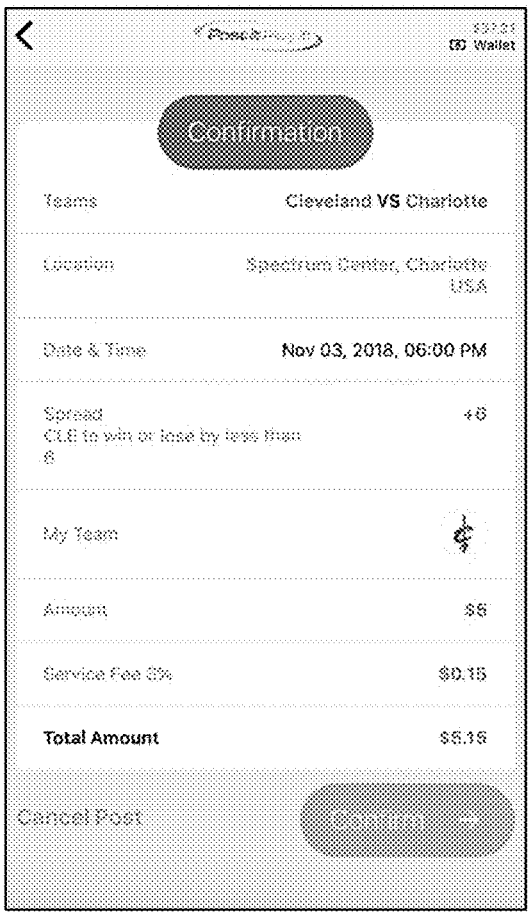

FIG. 23A illustrates one non-limiting exemplary embodiment of a portal for viewing open competitions or games, view details for each competition, and the ability to view create or participate in a competition, contest, or challenge. FIG. 23B illustrates one non-limiting exemplary embodiment of a portal for viewing the details of a selected competition, such as a competition for which the user is current participating in or has posted, or competitions created or posted by others users, including the defined spread/line, wagered amount(s) by each user, among others. FIG. 24A illustrates one non-limiting exemplary embodiment of a portal for a user to view available games/competitions and to create and post a competition. Once the user selects a particular competition, then the user can be directed to the portal of FIG. 24B. FIG. 24B illustrates one non-limiting exemplary embodiment of a portal for a user to create and post a competition, such as selecting the desired team, defining the spread (such as via a slider or manually entered spread), and defining the wagered amount, and submitting the created competition for posting on the CWE. FIGS. 25A-25B illustrate additional non-limiting exemplary embodiments of a portal for user to create and post a competition, and confirming the competition. In addition, the foregoing embodiments with respect to the portals can include a global feature, indicia, or icon for displaying the user's funds in his or her wallet or account within the CWE network, wherein the user has the ability to select the wallet indicia for adding additional funds, as previously disclosed herein.

It is contemplated within the scope of the disclosure described herein that the CWE can use any type of computer-based methods comprised of sophisticated algorithms, fuzzy logic algorithm, artificial intelligence, machine learning, weighting, certain weights assigned to one or more users, competitions, competitors, teams, sides, and the like, mathematical models, advanced programs, electronic databases, analytical tools and experts in sports/economics, statistics, modeling, programming, systems, performance, integration, legal affairs, government regulations, marketing and sales, administration, management, forecasting and simulation software, non-regression mathematical techniques, trend-based forecasting methods, probability and game theory methods, surveys, and blended techniques, in order to define, model, analyze, calculate, forecast, simulate and/or develop rate, score, or grade predictions, odds, and the like.

From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

The invention claimed is:

1. A non-transitory computer readable medium having computer-executable instructions for execution by one or more computing devices for a peer-to-peer competition wagering system, the computer-executable instructions comprising the steps of:

receiving schedule data associated with a first competition or event;

receiving a selection from a first user to participate in the first competition or event and a selection from a second user to participate in the first competition;

receiving a selection from the first user for a first competitor associated with the first competition or event, and receiving a selection from the second user for a second competitor associated with the first competition or event, and upon receiving the selection for the first competitor or second competitor, providing a pre-determined spread or line suggestion to the first or second user with respect to the first competitor or the second competitor, wherein the pre-determined spread or line suggestion is based on a third-party market maker's spread or line;

receiving a first wagered, placed, or contributed monetary amount or token of value with respect to the selected first competitor from the first user, and receiving a second wagered, placed, or contributed monetary amount or token of value with respect to the selected second competitor from the second user;

receiving a first point spread or line with respect to the first competition or event from the first user, and receiving a second point spread or line with respect to the first competition or event from the second user;

receiving a request to generate a first challenge, contest, or campaign based on the received selected first competitor, received first wagered amount, and received first point or spread by the first user;

receiving a request to generate a second challenge, contest, or campaign based on the received selected second competitor, received second wagered amount, and received second point spread or line by the second user;

upon determining that the first point spread or line is the opposite of the second point spread or line such that the sum total is zero, then automatically providing a notification to the first user to join the second challenge, contest, or campaign or a notification to the second user to join the first challenge, contest, or campaign;

tracking one or more activities of the first user and second user with respect to one or more competitions, point spreads or lines, and wagered monetary amounts or tokens of value for each of the first user and second user;

receiving outcome or score data with respect to the first competition or event;

determining a winner, loser, or draw between the first user and second user in the first or second challenge, contest, or campaign based on the received outcome or score data with respect to the first competition or event; and upon determining the winner between the first and second user, calculating a monetary amount or token of value to be awarded to the winning first or second user, and automatically transferring to a financial account of the winning first or second user the calculated monetary amount or token of value.

2. The non-transitory computer readable medium of claim 1, wherein the computer-executable instructions further comprise the step of publishing the first or second challenge, contest, or campaign within a peer-to-peer network forum.

3. The non-transitory computer readable medium of claim 2, wherein the computer-executable instructions further comprise the step of receiving a request from the second user or a third user to participate in the first contest, campaign, or challenge.

4. The non-transitory computer readable medium of claim 1, wherein the computer-executable instructions further comprise wherein the first or second point spread or line is defined via an interactive visual slider.

5. The non-transitory computer readable medium of claim 1, wherein the computer-executable instructions further comprise wherein a minimum and maximum value for the first or second point spread or line is pre-defined.

6. The non-transitory computer readable medium of claim 1, wherein the computer-executable instructions further comprise the step of creating the financial account for the first or second user for receiving the monetary amount or token of value.

7. A non-transitory computer readable medium having computer-executable instructions for execution by a processing system for a peer-to-peer competition wagering system, the computer-executable instructions comprising the steps of:

receiving scheduling data associated with a first competition or event;

receiving a selection from a first user and a second user to participate in the first competition comprised of a first competitor and a second competitor;

receiving a selection from the first user for the first competitor and the second user for the second competitor associated with the first competition;

receiving a first wagered monetary amount or token of value with respect to the selected first competitor from the first user, and a second wagered monetary amount or token of value with respect to the selected second competitor from the second user;

receiving a first point spread or line with respect to the first competitor from the first user, and a second point spread or line with respect to the second competitor from the second user;

generating a first challenge, contest, or campaign based on the received selected first competitor, received first wagered amount, and received first point or spread by the first user, and generating a second challenge, contest, or campaign based on the received selected second competitor, received second wagered amount, and received second point spread or line; and determining if the first point spread or line and the second point spread or line are opposites values with respect to each other, then automatically notifying the first user of the second challenge, contest, or campaign and the second user of the first challenge, contest, or campaign with respect to the first competition; and upon conclusion of the first competition or event, determining a winner between the first or second user, and automatically transferring to a financial account of the winning first or second user the first or second wagered, placed, or contributed monetary amount or token of value.

8. The non-transitory computer readable medium of claim 7, wherein the computer-executable instructions further comprise the step of receiving outcome or score data with respect to the first competition or event.

9. The non-transitory computer readable medium of claim 8, wherein the computer-executable instructions further comprise the step of determining a loser or draw between the first user and second user in the first or second challenge based on the received outcome or score data with respect to the first competition or event.

10. The non-transitory computer readable medium of claim 7, wherein the computer-executable instructions further comprise wherein a minimum and maximum value for the first or second point spread or line is pre-defined.

11. The non-transitory computer readable medium of claim 7, wherein the computer-executable instructions further comprise the step of creating an account for the first and second user for receiving monetary amount or token of value from each of the first and second users.

12. A non-transitory computer readable medium having computer-executable instructions for execution by HA one or more computers for a peer-to-peer competition wagering network, the computer-executable instructions comprising the steps of:

receiving schedule data associated with a first competition or event;

receiving a selection from a first user to participate in the first competition or event and a selection from a second user to participate in the first competition;

receiving a selection from the first user for a first competitor associated with the first competition or event, and receiving a selection from the second user for a second competitor associated with the first competition or event;

receiving a first wagered, placed, or contributed monetary amount or token of value with respect to the selected first competitor from the first user, and receiving a second wagered, placed, or contributed monetary amount or token of value with respect to the selected second competitor from the second user;

receiving a first point spread or line with respect to the first competition or event from the first user, and receiving a second point spread or line with respect to the first competition or event from the second user;

receiving a request to generate a first contest, challenge, or campaign based on the received selected first competitor, received first wagered amount, and received first point or spread by the first user;

receiving a request to generate a second contest, challenge, or campaign based on the received selected second competitor, received second wagered amount, and received second point spread or line by the second user;

on the condition that the first point spread or line or second point spread or line are opposites in numerical value with respect to each other, then automatically associating the second contest with the first contest or automatically associating the first contest with the second contest; and determining a winner between the first or second user, and automatically transferring to a financial account of the winning first or second user a monetary amount or token of value.

13. The non-transitory computer readable medium of claim 12, wherein the computer-executable instructions further comprise the step of receiving outcome or score data with respect to the first competition or event.

14. The non-transitory computer readable medium of claim 13, wherein the computer-executable instructions further comprise the step of determining a loser or draw between the first user and second user in the first or second contest based on the received outcome or score data with respect to the first competition or event.

15. The non-transitory computer readable medium of claim 12, wherein the computer-executable instructions further comprise wherein the first or second point spread or line is defined via an interactive visual slider.

16. The non-transitory computer readable medium of claim 12, wherein the computer-executable instructions further comprise wherein a minimum and maximum value for the first or second point spread or line is pre-defined.

* * * * *